US005745820A

United States Patent [19]

Iwakura et al.

[11] Patent Number: 5,745,820

[45] Date of Patent: Apr. 28, 1998

[54] IMAGE FORMING APPARATUS WITH A POTENTIAL GENERATING DEVICE

[75] Inventors: Yoshie Iwakura, Narashino; Fumio Shimazu, Yamatokoriyama, both of Japan

[73] Assignee: Sharp Kabushiki Kaisha, Osaka, Japan

[21] Appl. No.: 733,573

[22] Filed: Oct. 18, 1996

[30] Foreign Application Priority Data

Oct. 24, 1995 [JP] Japan ..... 7-275757
Jun. 12, 1996 [JP] Japan ..... 8-149632

[51] Int. Cl.[6] ..... G03G 15/16; G03G 15/01

[52] U.S. Cl. ..... 399/45; 399/66; 399/303; 399/314

[58] Field of Search ..... 399/66, 303, 304, 399/308, 310, 314, 298, 45

[56] References Cited

U.S. PATENT DOCUMENTS

| | | | |
|---|---|---|---|
| 5,187,526 | 2/1993 | Zaretsky . | |
| 5,249,023 | 9/1993 | Miyashiro et al. | 399/303 |
| 5,287,163 | 2/1994 | Miyashiro et al. . | |
| 5,390,012 | 2/1995 | Miyashiro et al. | 399/303 |
| 5,530,532 | 6/1996 | Iino et al. | 399/237 |
| 5,565,970 | 10/1996 | Suda | 399/406 |
| 5,623,329 | 4/1997 | Yamauchi et al. | 399/314 |

FOREIGN PATENT DOCUMENTS

| | | |
|---|---|---|
| 0548803 | 6/1993 | European Pat. Off. . |
| 0666518 | 8/1995 | European Pat. Off. . |
| 0708385 | 4/1996 | European Pat. Off. . |
| 0737901 | 10/1996 | European Pat. Off. . |
| 250187 | 2/1990 | Japan . |
| 2-74975 | 3/1990 | Japan . |
| 5-173435 | 7/1993 | Japan . |

*Primary Examiner*—Joan H. Pendegrass

[57] ABSTRACT

A transfer drum has a dielectric layer and a conductive layer laminated in this order from a transfer material side. The transfer drum is provided with a power source section for applying a predetermined voltage to the conductive layer, and a grounded semiconductive roller, formed on the surface of the dielectric layer by using a semiconductor having elasticity. The semiconductive roller is brought into contact with the dielectric layer through the transfer material. For this reason, since a nip width, namely, a nip time can be easily adjusted, even if a type of the transfer material is changed, for example, the transfer material can electrostatically adhere to the transfer drum stably. As a result, unsatisfactory transfer of a toner image to the transfer material is eliminated, and thus the satisfactory image can be formed on the transfer material. Moreover, an image forming apparatus having a low-priced arrangement can be provided.

40 Claims, 22 Drawing Sheets

IMAGE FORMING APPARATUS WITH A POTENTIAL GENERATING DEVICE

FIELD OF THE INVENTION

The present invention relates to an image forming apparatus which is used for a laser printer, a copying machine, a laser facsimile, etc. and more specifically relates to an arrangement of transfer means such as a transfer drum for performing toner transfer plural times while a transfer material is being held.

BACKGROUND OF THE INVENTION

Conventionally, there exists an image forming apparatus for developing an electrostatic latent image formed on a photoreceptor drum by attracting toner to the electrostatic latent image so as to transfer the toner image to a transfer material which is wound around a transfer drum.

An example of such an image forming apparatus is an image forming apparatus shown in FIG. 31 in which a corona charger 102 for attracting a transfer material P, and a corona charger 104 for transferring a toner image formed on the surface of a photoreceptor drum 103 to the transfer material P are separately placed inside a cylinder 101 having a dielectric layer 101*a*. In the image forming apparatus, the transfer material P is attracted and the transfer process to the transfer material P is performed respectively by the corona chargers 102 and 104.

In addition, a second image forming apparatus shown in FIG. 32, is provided with a cylinder 201 having a double-layer structure formed by a semi-conductive layer 201*a* as an outer layer and a substrate 201*a* as an inner layer, and a grip mechanism 202 for holding the transported transfer material P around the cylinder 201. In the image second forming apparatus, after the transported transfer material P is held by the grip mechanism 202 around the cylinder 201, the toner image on the photoreceptor drum 103 is transferred to the transfer material P by applying a voltage to the semi-conductive layer 201*a* as the outer layer of the cylinder 201 or charging a surface of the cylinder 201 by discharges of a charger in the cylinder 201.

However, in an image forming apparatus as shown in FIG. 31, since the cylinder 101 as the transfer roller has a single-layer structure formed by only the dielectric layer 101*a*, it is necessary to dispose the corona chargers 102 and 104 therein. This structure restricts the size of the cylinder 101 and prevents a reduction in the size of the image forming apparatus.

In the second image forming apparatus shown in FIG. 32, since the cylinder 201 which operates as the transfer roller has a double-layer structure. As a result, a number of charges can be reduced. However, the grip mechanism 202 is included in the second image forming apparatus, the overall structure of the apparatus becomes complicated. As a result, the total number of component parts in the apparatus and the manufacture cost of the apparatus are increased.

In order to solve the above problems, for example, Japanese Unexamined Publication No. 2-74975/1990 (Tokukaihei) discloses a third image forming apparatus, which has a structure in which a transfer drum is formed by laminating a grounded metal roller with a conductive rubber and a dielectric film, and a corona charger is disposed in the vicinity of a position where transfer material is separated from the transfer drum. In this structure, the corona charger is driven by an unipolar power source.

In this third image forming apparatus, a transfer material is attracted to the transfer drum by inducing electric charges on the dielectric film by the corona charger. Moreover, when the transfer material is attracted, electric charges are further induced so that a transfer process is performed.

In the third image forming apparatus, since the transfer material is attracted by charging the surface of the transfer drum using one charger so that the transfer is executed, only one charger is required. As a result, the size of the transfer drum can be small. Moreover, the third image forming apparatus does not require a mechanism such as the grip mechanism 202 for holding the transfer material, thereby making it possible to attract the transfer material in the simple structure.

However, in the third image forming apparatus, the surface of the transfer drum is charged by atmospheric discharges of the corona charger. Therefore, when forming a color image, i.e., when executing a transfer process plural times, charges are supplied by the corona charger every time a transfer is completed. It is thus necessary to include a charger unit formed by, for example, an unipolar power source. This causes increases in the number of component parts of the apparatus and the manufacture cost of the apparatus.

In addition, when the surface of the transfer drum is scratched and when charging is carried out by atmospheric discharges, an electric field becomes weaker and loses its balance at the scratched area. Consequently, a transfer defect occurs, for example, a blank portion is produced at the scratched area, lowering the image quality.

Additionally, in the third image forming apparatus, since the surface of the transfer drum is charged by atmospheric discharges, an increased voltage is required for charging, and the driving energy of the image forming apparatus becomes larger. Moreover, since the atmospheric discharges are easily affected by environmental conditions such as the temperature and moisture in the air, the surface potential of the transfer roller tends to be varied. As a result, failure in attracting the transfer material and disorderly images are likely to occur.

In addition, Japanese Unexamined Patent Publication No. 5-173435/1993 (Tokukaihei 5-173435) discloses a fourth image forming apparatus which is provided with a transfer drum including at least an elastic layer made of a foaming substance and a dielectric layer covering the elastic layer. In the fourth image forming apparatus, various colored toner images formed on the photoreceptor drum are transferred successively on a transfer material attracted to the transfer drum so as to be superimposed on each other. Then, a color image is formed on the transfer material.

In the fourth image forming apparatus, when holding a transfer material on the transfer drum, an attracting roller as charge supplying means is used. Namely, in the fourth image forming apparatus, the transfer material is electrostatically attracted to the transfer drum by the attracting roller. Furthermore, in the fourth image forming apparatus, in order to improve attracting ability, namely, an attracting characteristic of the transfer material, a void layer with a thickness of not less than 10 μm is provided between the elastic layer and the dielectric layer.

However, in the fourth image forming apparatus, the hardness of the elastic layer (foaming layer) and contact pressure between the attracting roller and the transfer drum are not defined. Moreover, a length of a contact portion formed between the attracting roller and the transfer drum (namely, nip width) and time required for passing of an arbitrary position of the transfer material through the nip width (namely, nip time) are not described in the Publication. As a result, it is considered that when any type of transfer materials are used, the nip time is constant.

However, in general, it is known that since the type of transfer materials is varied, a charging amount of electric charges (charging potential) of the transfer material within constant nip time is varied. As a result, it is considered that electrostatic adhering force which is required for electrostatically attracting the transfer material to the transfer drum is fairly varied with the type of transfer materials. Namely, when the nip time is set constant for any type of transfer materials, in some cases, the transfer material is not electrostatically attracted to the transfer drum stably according to the type of transfer materials because a charging amount of electric charges (charging potential) of the transfer material within constant time is varied with the type of transfer materials. In this case, when forming a color image, the electrostatic adhering force of the transfer material to the transfer drum decreases, and thus the transfer material is removed from the transfer drum before all the various colored toner images formed on the transfer drum are transferred to the transfer material. As a result, the transfer process cannot be performed satisfactorily.

Therefore, it is necessary to change a supplying amount of electric charges according to the type of transfer materials. However, the above Publication does not disclose means for changing a supplying amount of electric charges according to the type of transfer materials.

In the means for changing a supplying amount of electric charges according to the type of transfer materials, for example, it is considered that the toner transfer and the attraction of the transfer material are performed by respective power sources, and an applied voltage is varied with the type of transfer materials so that a surface potential of the transfer materials is controlled. However, in this case, this means requires at least two power sources, i.e. an attracting roller power source for attracting the transfer material to the transfer drum and a power source for applying a voltage having opposite polarity to toner to the transfer materials when performing the transfer using the toner. As a result, the manufacture cost of the apparatus increases.

In addition, in the image forming apparatus ④, since the dielectric layer and the elastic layer (foaming layer) are laminated, a minute void layer exists between the dielectric layer and the elastic layer. As a result, it is considered that water drops exist in the void layer according to the environment, and the thickness of the void layer is varied. Therefore, the fourth image forming apparatus has unstable arrangement. Namely, at high humidity the attracting ability of the transfer material is lowered because of water drops in the minute void layer, whereas at low humidity excessive residual electric charges occur on the dielectric layer after removing the transfer material, thereby exerting bad influences on attracting of the next transfer material.

Furthermore, since the fourth image forming apparatus adopts a foaming substance as a material of the elastic layer of the transfer drum, it is difficult to change a supplying amount of electric charges according to the type of transfer materials (paper OHP or synthetic resin sheets) and the environment. Therefore, the fourth image forming apparatus cannot respond to the change of the type of transfer materials and the environment, and thus the electrostatic attracting of the transfer material and the transfer using toner cannot be always performed stably.

Additionally, in general, as the thickness of the void layer becomes larger, the applied voltage for electrostatically attracting the transfer material on the dielectric layer becomes higher. Therefore, the above image forming apparatus has a problem in safety and a disadvantage of the manufacture cost.

SUMMARY OF THE INVENTION

It is an object of the present invention to provide an image forming apparatus, having a low-priced arrangement, for making a transfer material adhere to a surface of a transfer drum such as a transfer drum stably, and thus an image is satisfactorily formed on the transfer material without unsatisfactory transfer of a toner image to the transfer material. In order to achieve the above object, the image forming apparatus of the present invention has:

- a photoreceptor drum on which a toner image is formed;
- a transfer drum for transferring the toner image formed on the photoreceptor drum onto a transfer material by bringing the transfer material into contact with the photoreceptor drum, the transfer drum having a dielectric layer and a conductive layer laminated in this order from a contact surface side of the transfer material;
- a power source section, connected to the conductive layer, for applying a predetermined voltage to the conductive layer; and
- a potential difference generating member, which is brought into contact with the surface of the dielectric layer through the transfer material and is made of at least a semiconductive body having elasticity, for generating a potential difference between the dielectric layer to which the voltage is applied and the transfer material, the potential difference generating member being provided on an upper stream side of a feeding direction of the transfer material from a transfer position on the surface of the dielectric layer.

It is preferable that the potential difference generating member is a grounded electrode member. As the potential difference generating member, concretely, a grounded semiconductive roller or a grounded semiconductive belt can be used.

In accordance with the above arrangement, when the voltage is applied to the conductive layer, electric charges are stored in the dielectric layer. Then, since the transfer material is fed between the transfer drum and the potential difference generating member, and the potential difference generating member is brought into contact with the dielectric layer through the transfer material, electric charges are induced to the transfer material by Paschen discharge and injection of electric charges due to the Paschen discharge. As a result, the transfer material electrostatically adheres to the transfer drum by an attracting force between electric charges due to a voltage to be applied by the power source section and electric charges on the surface of the transfer material. Moreover, the toner image is transferred onto the transfer material by a potential difference between the electric charges due to the voltage applied by the power source section and the electric charges of the toner image on the surface of the photoreceptor drum.

As mentioned above, in the image forming apparatus, execute adhesion and transfer on the transfer material are not executed by injecting electric charges using atmospheric discharge unlike the conventional manner. Since such adhesion and transfer are executed by local discharge and injection of electric charges in a minute void between the transfer drum and the potential difference generating unit, a low voltage is enough for use and the voltage can be easily controlled. Moreover, dispersion of the voltage due to circumferential environment can be eliminated, and a generating amount of ozone is comparatively low.

As a result, since the voltage to be applied to the transfer drum can be retained constant without any influence due to environment such as humidity and temperature, the transfer efficiency and image quality can be improved.

In addition, since the voltage may be applied to only one location, it is not necessary to apply a voltage to each charger unlike the conventional manner, thereby simplifying the apparatus and lowering costs of the manufacture.

In addition, the above image forming apparatus is capable of charging the surface of the transfer drum more stably compared to the conventional manner that electric charges are induced on the surface of the transfer drum by atmospheric discharge. As a result, the adhesion and transfer on the transfer material can be executed stably.

In addition, in accordance with the above arrangement, when the potential difference generating member is formed by a semiconductive body having elasticity, a width (nip width) in the moving direction of the transfer material at the contact portion between the transfer drum and the potential difference generating member can be easily adjusted. Therefore, the charging potential can be easily adjusted according to a type of the transfer material. Furthermore, when the potential difference generating member is formed by the semiconductive body, the transfer material electrostatically adheres to the transfer drum by not only the Paschen discharge and the injection of electric charges but also dynamics. Therefore, the electrostatic adhesion can be executed more stably.

Then, when the potential difference generating member is the semiconductive belt, the nip time can be easily adjusted, and a contact width in the feeding direction of the transfer material between the potential difference generating member and the transfer drum can be made longer. For this reason, when an OHP synthetic resin sheet, for example, is used as the transfer material, the nip time can be made longer. For this reason, the charging potential of the transfer material can be further increased, and thus the electrostatic adhesion can be executed more stably. Moreover, as mentioned above, when the semiconductive belt is used as the potential difference generating member, the contact width in the feeding direction of the transfer material between the potential difference generating member and the transfer drum can be made longer, thereby bringing the transfer material into contact with the transfer drum by a pressure for a long time. Therefore, when the semiconductive belt is used as the potential difference generating member, the transfer material can be curled along the transfer drum more easily compared with the case of a semiconductive roller. Therefore, the transfer material can be retained by adhesion more stably.

In addition, it is preferable that the above image forming apparatus further includes a nip time changing unit for changing the nip time for a predetermined position of the transfer material to pass through the contact portion between the transfer drum and the potential difference generating member according to a type of the transfer material. Moreover, it is preferable that the nip time changing unit includes a nip width adjusting unit for adjusting the nip width in the moving direction of the transfer material at the contact portion between the transfer drum and the potential difference generating member.

Namely, since the nip time is determined by <the nip width formed between the transfer drum and the potential difference generating member/rotating speed of the transfer drum>, the nip time can be easily changed by (i) changing the nip width which is a contact width between the potential difference generating member and the transfer drum with the rotating speed of the transfer drum constant or (ii) changing the rotating speed of the transfer drum with the nip width constant. At this time, when the nip time changing unit changes the contact width between the potential difference generating member and the dielectric layer, the nip time is changed. Therefore, the nip time can be easily changed without lowering the transfer efficiency.

Even if a physical property of the potential difference generating member (resistance), a physical property of the dielectric layer (resistance), an applied voltage or a type of the transfer material is changed, the relationship between the nip time and the amount of electric charges (charging potential) on the transfer material is mainly divided into the following three patterns:

- a pattern that the amount of electric charges (charging potential) of the transfer material has a maximal value accordingly to a change in the nip time;
- a pattern that the amount of electric charges (charging potential) of the transfer material increases as the nip time becomes longer; and
- a pattern that the amount of electric charges (charging potential) of the transfer material decreases as the nip time becomes longer. As a result, when the nip time is changed according to a type of the transfer material to be used, the electric charges are injected efficiently.

Therefore, with the present embodiment, even if the type of the transfer material is changed as mentioned above, the nip time can be easily changed. As a result, since the injecting amount of electric charges can be easily controlled, the transfer material can be made electrostatically adhere to the dielectric layer stably. As a result, the toner can be satisfactorily transferred from the photoreceptor drum to the transfer drum without removing the transfer material from the transfer drum before all the toner images in each color formed on the photoreceptor drum are transferred onto the transfer material. Therefore, a stable image can be always supplied.

In addition, in order to achieve the above object, the image forming apparatus of the present invention has: a photoreceptor drum on which a toner image is formed; a transfer drum for transferring the toner image formed on said photoreceptor drum onto a transfer material by bringing the transfer material into contact with the photoreceptor drum, the transfer drum having a dielectric layer and a conductive layer laminated in this order from a contact surface side of the transfer material; a power source section, connected to said conductive layer, for applying a predetermined voltage to the conductive layer; and a potential difference generating member, which is brought into contact with the surface of the dielectric layer through the transfer material, for generating a potential difference between the conductive layer to which the voltage is applied and the transfer material, the potential difference generating member being provided on an upper stream side of a feeding direction of the transfer material from a transfer position on the surface of the dielectric layer, wherein the photoreceptor drum and the potential difference generating member are located in a position where a forward end of the transfer material in the feeding direction is in contact with the photoreceptor drum after a backward end of the transfer material in the feeding direction passes through the potential difference generating member. It is preferable that the potential difference generating member is formed by a semiconductive body having elasticity, and more preferable, a grounded electrode material.

In addition, it is preferable that the image forming apparatus further includes a voltage switching unit for switching the voltage of the power source section before the forward end of the transfer material in the feeding direction is brought into contact with the photoreceptor drum after a backward end of the transfer material in the feeding direction passes through the potential difference generating member.

In accordance with the above arrangement, electric charges are stored on the dielectric layer by applying a voltage to the conductive layer. The transfer material is fed between the transfer drum and the potential difference generating member, and the potential difference generating member is brought into contact with the dielectric layer through the transfer material. Then, electric charges are induced on the transfer material by the Paschen discharge and the injection of the electric charges due to the Paschen discharge. As a result, the transfer material electrostatically adheres to the transfer drum by an attracting force the electric charges due to the voltage applied by the power source section and the electric charges on the transfer material. Moreover, the toner image is transferred onto the transfer material by a potential difference between the electric charges due to the voltage applied by the power source section and the electric charges of the toner image on the photoreceptor drum.

As mentioned above, in the above image forming apparatus, the adhesion and transfer on the transfer material are not executed by the injection of electric charges using atmospheric discharge unlike the conventional manner, and thus the adhesion and transfer on the transfer material are executed by the local discharge and the injection of electric charges in a minute void between the transfer drum and the potential difference generating member. For this reason, a low voltage may be sufficient for use, and the voltage can be easily controlled. Moreover, dispersion of the voltage due to circumferential environment can be eliminated, and a generating amount of ozone is comparatively low.

As a result, since the voltage to be applied to the transfer drum can be retained constant without any influence due to environment such as a humidity and a temperature, the transfer efficiency and the image quality can be improved.

In addition, since the voltage may be applied to only one location, it is not necessary to apply a voltage to each charger unlike the conventional manner, thereby simplifying the apparatus and lowering costs of the manufacture.

In addition, the above image forming apparatus is capable of charging the surface of the transfer drum more stably compared to the conventional manner that electric charges are induced on the surface of the transfer drum by atmospheric discharge. As a result, the adhesion and transfer on the transfer material can be executed stably.

In addition, in accordance with the above arrangement, when the potential difference generating member is formed by a semiconductive body having elasticity, a width (nip width) in the moving direction of the transfer material at the contact portion between the transfer drum and the potential difference generating member can be easily adjusted. Therefore, the charging potential can be easily adjusted according to a type of the transfer material. Furthermore, when the potential difference generating member is formed by the semiconductive body, the transfer material is electrostatically attracted to the transfer drum by not only the Paschen discharge and the injection of electric charges but also dynamics. Therefore, the electrostatic adhesion can be executed more stably.

In addition, when the photoreceptor drum and the potential difference generating member are located in a position where the forward end of the transfer material in the feeding direction is brought into contact with the photoreceptor drum after the backward end of the transfer material in the feeding direction passes through the potential difference generating member, the applied voltage by the voltage applying unit can be switched by, for example, the voltage switching unit, according to the period of the transfer material in contact with the potential difference generating member and the period of the transfer material in contact with the photoreceptor drum. For this reason, when a voltage to be applied to the conductive layer required for the transfer material to electrostatically adhere and a voltage required for the toner transfer are applied, different voltages can be applied by one power source. For this reason, the electrostatic adhesion and the toner transfer on the dielectric layer can be executed stably only by the above voltage applying unit. Moreover, since only the power source section is used as the power source, the apparatus can be simplified, and costs of the manufacture can be a low-price.

In addition, as mentioned above, in order to locate the photoreceptor drum and the potential difference generating member in a position where the forward end of the transfer material in the feeding direction is brought into contact with the photoreceptor drum after the backward end of the transfer material in the feeding direction passes through the potential difference generating member, for example, a distance from the potential difference generating member to the photoreceptor drum towards the feeding direction of the transfer material may be a length which is longer than a maximum longitudinal feeding size of the transfer material.

For fuller understanding of the nature and advantages of the invention, reference should be made to the ensuing detailed description taken in conjunction with the accompanying drawings.

DETAILED DESCRIPTION OF THE PREFERRED EMBODIMENTS

[EMBODIMENT 1]

The following describes one embodiment of the present invention on reference to FIGS. 1 through 13.

Figure 1:
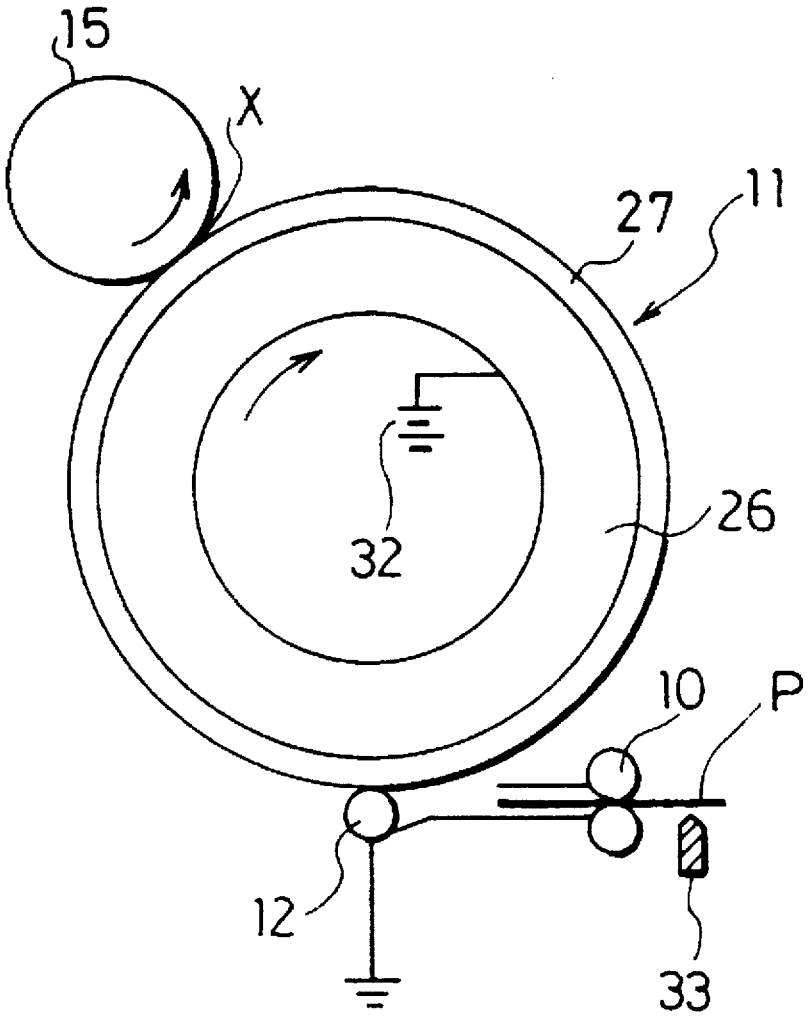
FIG. 1 is a schematic constitutional drawing which shows the proximity of a transfer drum provided to an image forming apparatus according to embodiment 1 of the present invention.
Figure 2:
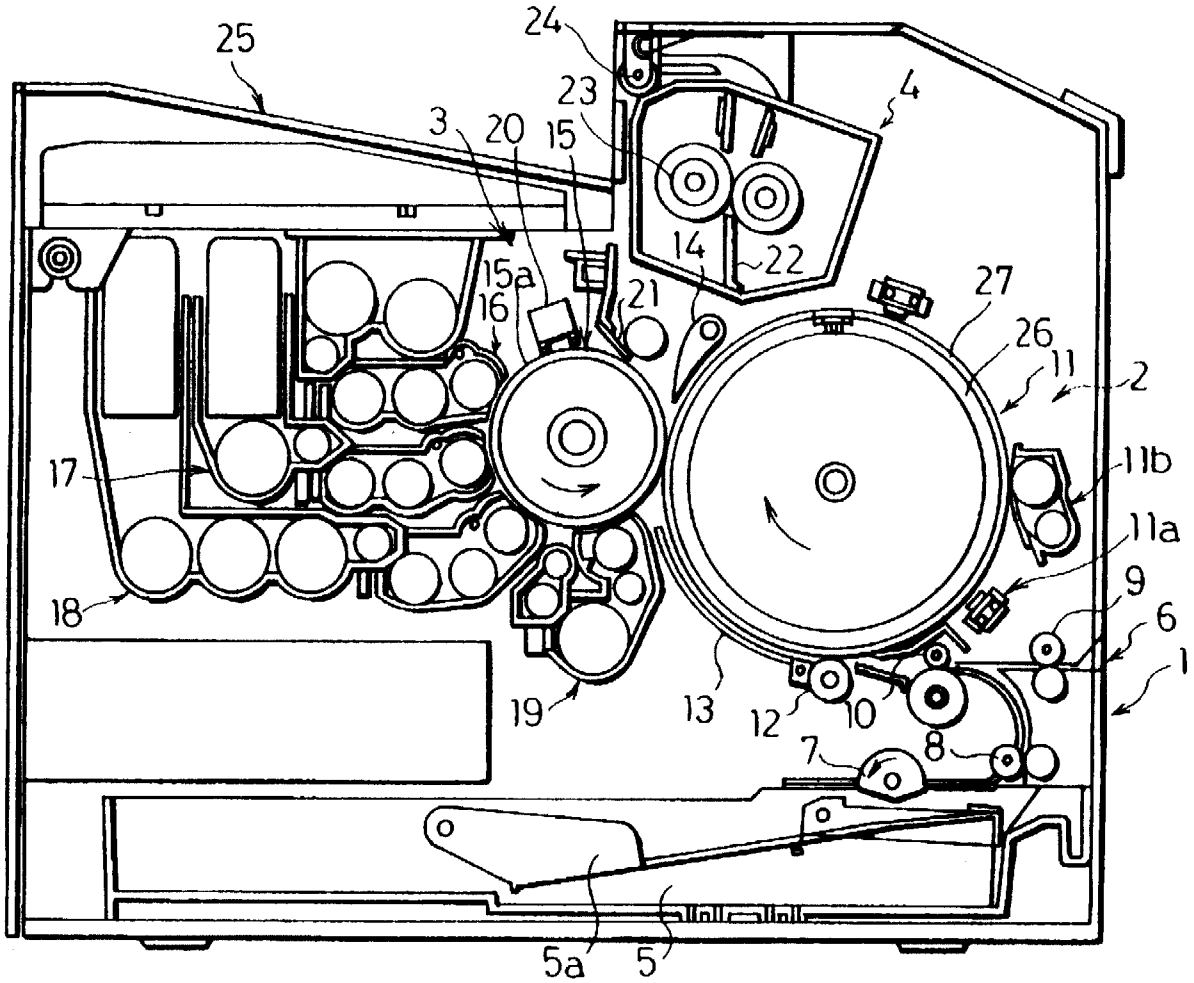
FIG. 2 is a schematic constitutional drawing which shows an image forming apparatus having the transfer drum and a semiconductor roller shown in FIG. 1.

As shown in FIG. 2, an image forming apparatus of the present embodiment is arranged so as to have a feeding section 1, a transfer section 2, a developing section 3 and a fixing section 4. The feeding section 1 stores and feeds a transfer material P (see FIG. 1), such as a sheet-like transfer material, as recording paper on which an image is formed by toner. The transfer section 2 transfers a toner image to the transfer material P. The developing section 3 forms the toner image. The fixing section 4 fuses and fixes the toner image transferred to the transfer material P.

The feeding section 1 includes a feed cassette 5, a manual-feed section 6, a pickup roller 7, PF (pre-feed) rollers 8, a manual-feed rollers 9 and PS (pre-curl) rollers 10. The feed cassette 5 is disposed on the lowest level of a main body so as to be freely attachable to and detachable from the main body. The feed cassette 5 stores the transfer materials P and supplies them to the transfer section 2. The manual-feed section 6 is located on the front side of the main body and through which the transfer material P manually supplied one by one from the front side. The pickup roller 7 feeds one transfer material P at a time from the topmost one of transfer materials P in the feed cassette 5. The PF rollers 8 transport the transfer materials P fed by the pickup roller 7. The manual-feed rollers 9 transport the transfer material P fed from the manual-feed section 6. The PS rollers 10 curl the transfer material P transported by the PF rollers 8 and the manual-feed rollers 9.

In addition, the feed cassette 5 is provided with a feeding member 5*a* pressed by, for example, a spring. The transfer materials P are piled up on the feeding member 5*a*. As a result, the topmost material of the transfer materials P in the feed cassette 5 comes into contact with the pickup roller 7. When the pickup roller 7 is rotated in the direction of an arrow, the transfer material P is fed one by one to the PF rollers 8. The transfer materials P are then transported to the PS rollers 10.

Meanwhile, the transfer materials P supplied from the manual-feed section 6 are also transported to the PS rollers 10 by the manual-feed rollers 9.

As mentioned above, the PS rollers 10 curl the transported transfer material P so that the transfer material P easily adheres to a surface of a cylindrical transfer drum 11 in the transfer section 2.

The transfer section 2 is provided with the transfer drum 11 as the above-mentioned transfer means. Disposed around the transfer drum 11 are a semiconductive roller (potential-difference generating means) 12, a guide member 13 and a separating claw 14. The semiconductive roller 12 is a grounded electrode member made of a semiconductive body having elasticity, and is brought into contact with the transfer drum 11 through the transfer material P. The guide member 13 guides the transfer material so that the transfer material is not separated from the transfer drum 11. The separating claw 14 forcefully separates the transfer material P adhering to the transfer drum 11. The semiconductive roller 12 is brought into contact with a surface of a dielectric layer 27 of the transfer drum 11 through the transfer material P at an upstream section above the transfer position of a toner image to the transfer material P onto the transfer drum 11.

In addition, the transfer drum 11 attracts the transfer material P to its surface by static electricity. Therefore, a charge eliminating unit 11*a* as charge eliminating means is also provided around the transfer drum 11. After the transfer material P is removed from the transfer drum 11, the charge eliminating unit 11*a* interacts with the transfer drum 11 so as to remove residual electric charges adhering to the transfer drum 11 at the time of, for example, removing the transfer material P. The charge eliminating unit 11*a* is provided on the upstream section above the semiconductive roller 12. As a result, the residual electric charges do not exist on the transfer drum 11, and thus next transfer material P is adheres to the transfer drum 11 stably.

In addition, a cleaning unit 11*b* as cleaning means is provided on the upstream section above the charge eliminating unit 11*a* around the transfer drum 11. After the transfer material P is removed from the transfer drum 11, the cleaning unit 11*b* interacts with the transfer drum 11 so as to remove residual toner adhering to the transfer drum 11. As a result, the transfer drum 11 is cleaned before next transfer material adheres thereto so that next transfer material P adheres thereto stably. The separating claw 14 is provided to the surface of the transfer drum 11 so as to be freely attachable to and detachable from the transfer drum 11. Moreover, the structure of the transfer drum 11 will be detailed later.

In addition, the developing section 3 is provided with a photoreceptor drum 15 as a photoreceptor drum which is pressed against the transfer drum 11. The photoreceptor drum 15 is made of a conductive aluminum tube 15*a* which is grounded, and an OPC film is formed thereon.

In addition, arranged radially around the photoreceptor drum 15 are developer containers 16, 17, 18 and 19, a charger 20, a laser, not shown, and a cleaning blade 21. The developer containers 16, 17, 18 and 19 respectively contain yellow, magenta, cyan and black toner. The charger 20 charges the surface of the photoreceptor drum 15. The cleaning blade 21 scrapes off residual toner from the surface of the photoreceptor drum 15. Toner images in the respective colors are formed on the photoreceptor drum 15. More specifically, with the photoreceptor drum 15, a series of charging, exposing, developing and transfer processes are repeated for each of toner colors. Here, when an emitted light from an optical system, not shown, is projected between the charger 20 and the cleaning blade 21, the surface of the photoreceptor drum 15 is exposed. Therefore, when transferring a color image, a toner image in one color is transferred onto the transfer material P which is electrostatically adheres to the transfer drum 11 by one rotation of the transfer drum 11. Namely, a color image is obtained by a maximum of four rotations of the transfer drum 11.

Considering the transfer efficiency and the image quality, the photoreceptor drum 15 and the transfer drum 11 are brought into contact with each other by pressure so that a pressure of 2 kg is applied at a transfer position.

In addition, the fixing section 4 is provided with fixing rollers 23 and a fixing guide 22. The fixing rollers 23 fix the toner image onto the transfer material P by fusing the toner image at a predetermined temperature and pressure. The fixing guide 22 guides the transfer material P, which has been separated from the transfer drum 11 by the separating claw 14 after the transfer of the toner image, to the fixing rollers 23.

In addition, a discharge roller 24 is provided at a downstream section of the feeding direction of the transfer material P in the fixing section 4 so as to discharge the fixed transfer material P from the main body of the apparatus onto a discharge tray 25.

The following describes the arrangement of the transfer drum 11.

As shown in FIG. 1, a conductive layer 26 made of cylindrical aluminum is used as a base material of the transfer drum 11, and a dielectric layer 27 is provided on the upper surface of the conductive layer 26. PVDF (polyvinylidene fluoride) or the like is used as the dielectric layer 27.

In addition, a power source section 32 as voltage applying means is connected to the conductive layer 26 so that a constant voltage is held throughout the conductive layer 26.

The following describes a manufacturing method and a fixing method of a dielectric layer 27.

Figure 12:
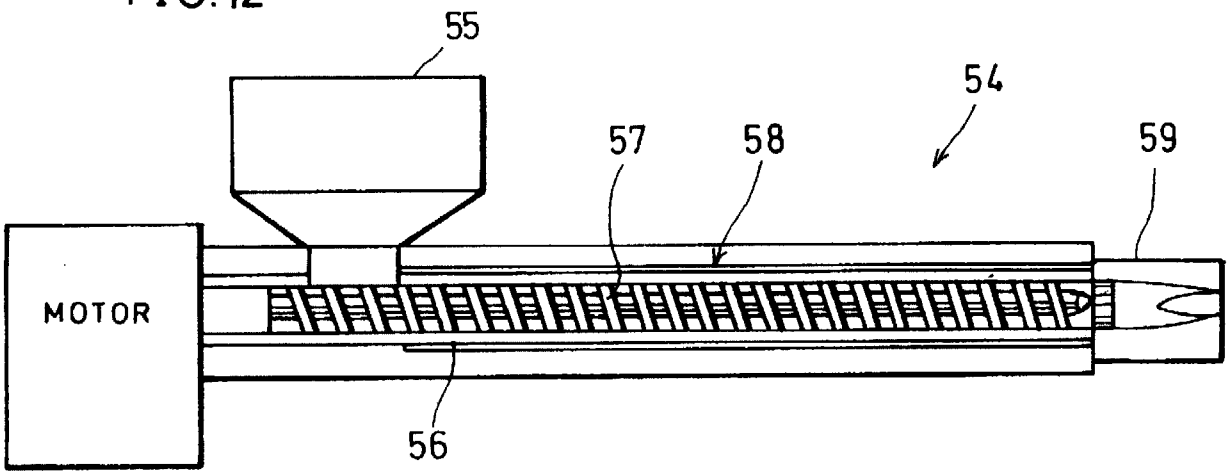
FIG. 12 is a schematic constitutional drawing which shows an extruder used in the manufacture process of the transfer drum of the present invention.
Figure 13:
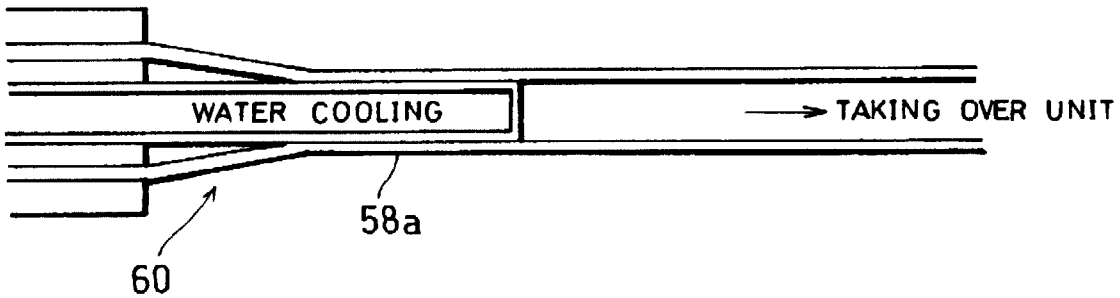
FIG. 13 is a schematic constitutional drawing which shows a taking-over unit used in the manufacture process of the transfer drum of the present invention.

First, the description is given as to the manufacturing method and the fixing method of the dielectric layer 27 when a cylindrical seamless thin film seat made of PVDF is used as the dielectric layer 27 on reference to FIGS. 12 and 13. Here, FIG. 12 shows a general extruder 54 for extruding a raw material by heating.

A raw material is supplied to a raw material hopper 55 of the extruder 54. The raw material is supplied from the raw material hopper 55 to a cylinder 56. The raw material supplied to the cylinder 56 is transferred to a die section 59 having a circular opening by a screw 57 in the cylinder 56. At this time, the raw material is heated by a heating/cooling unit 58 in the cylinder 56, and is plasticized. Then, the shape and thickness of the plasticized raw material are determined in the die section 59 (sizing).

As shown in FIG. 13, in the die section 59, the shape and size are defined while the raw material is being cooled and solidified in a cooling section 58*a* of a sizing section 60. Finally, the solidified raw material is cut into a desired size by a taking-over unit. Since the raw material is taken over from the circular opening of the die section 59, the seamless thin film seat can be formed. It is comparatively easy to provide a heat contracting characteristic to such a PVDF cylindrical seamless thin film seat. This heat shrinkage characteristic is such that molecular anisotropy is formed due to a change in the structure based upon a deformation of a polar chain high polymer having a heat fusing characteristic, and fixed alignment is collapsed due to reheating of molecular anisotropy and thus alignment is returned to the original state.

When the PVDF cylindrical seamless thin film seat is used as the dielectric layer 27, the dielectric layer 27 can be fixed on the conductive layer 26 by heat-contracting the cylindrical seamless thin film seat heat. As a result, adhesion of the conductive layer 26 and the dielectric layer 27 becomes extremely firm, and thus adhesion of the transfer material P to the transfer drum 11 and toner transferring ability are remarkably improved also in the case of multi-printing. The heat contraction includes a dry method and a wet method. The heat contraction by the dry method causes a small change in physical properties such as a resistance value and a dielectric constant of PVDF, so the dry method is preferable as the method of fixing the dielectric layer 27 on the transfer drum 11 of the present invention in which the dielectric constant and the resistance value of the dielectric layer 27 greatly exert a great influence on the attraction of the transfer material P and the toner transfer.

In addition, as the method of fixing the dielectric layer 27, a method of applying a conductive adhesive between the dielectric layer 27 and the conductive layer 26 can be also used. In this case, a minute void layer between the dielectric layer 27 and the conductive layer 26 can be eliminated, so the adhesion of the dielectric layer 27 and the conductive layer 26 becomes extremely firm. For this reason, electrostatic attracting of the transfer material P with respect to environmental changes becomes stable, thereby improving the toner transferring ability remarkably. Therefore, the transfer material P is not removed from the transfer drum 11 before all toner images of each color formed on the photoreceptor drum 15 are transferred to the transfer drum 11. As a result, the toner images can be transferred from the photoreceptor drum 15 to the transfer material P satisfactorily, thereby making it possible to always provide stable images.

Figure 3:
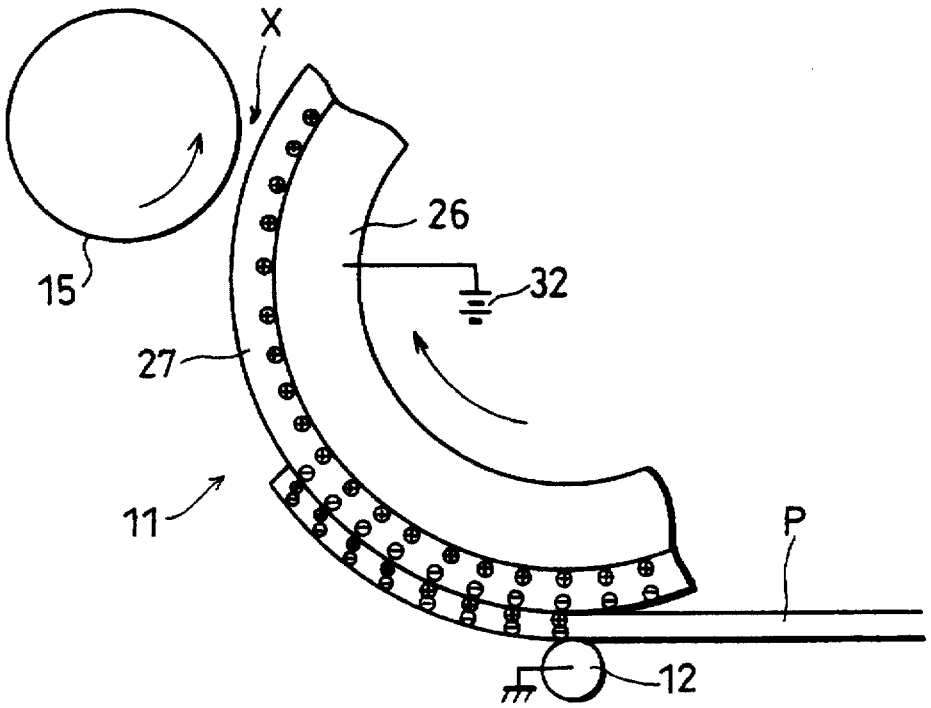
FIG. 3 is an explanatory drawing which shows the transfer drum shown in FIG. 1 in an charging condition, namely, an explanatory drawing which shows an initial condition where a transfer material is transported to the transfer drum.
Figure 4:
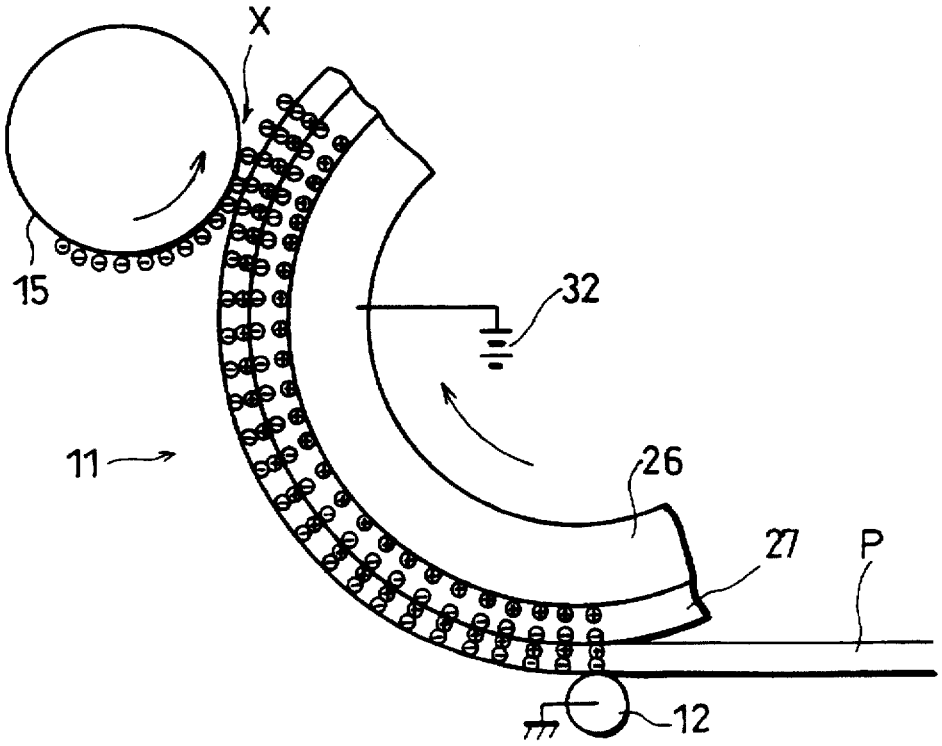
FIG. 4 is an explanatory drawing which shows charging condition on the transfer drum shown in FIG. 1, and shows a condition where the transfer material is transported to a transfer position of the transfer drum.
Figure 5:
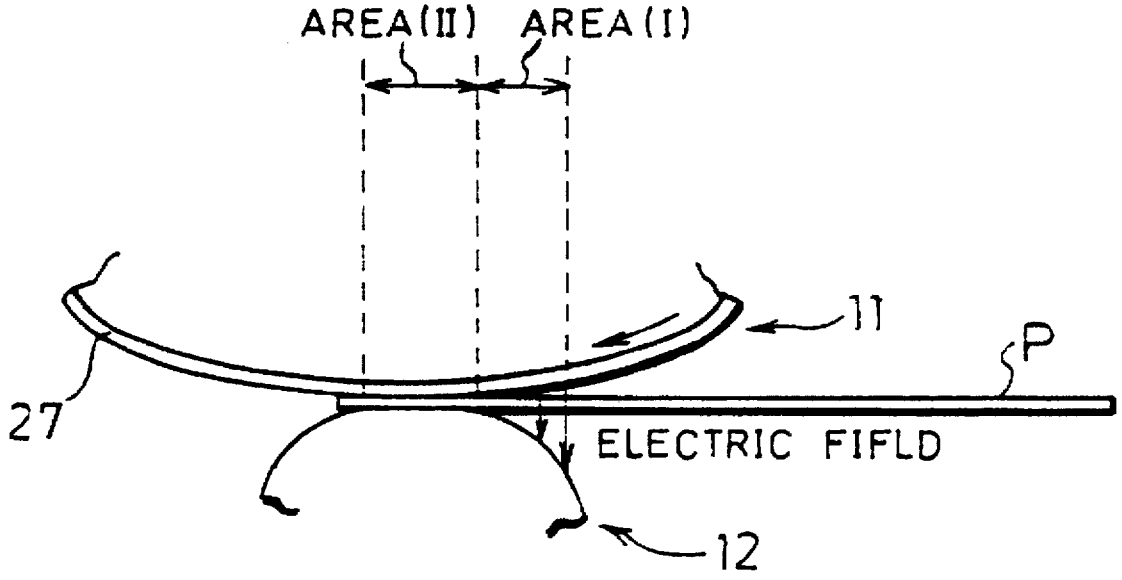
FIG. 5 is an explanatory drawing which shows Paschen's discharge in a close contact portion between the transfer drum and the semiconductor roller shown in FIG. 1.

The following describes the attracting and transferring operations of the transfer material P by means of the transfer drum 11 on reference to FIGS. 3 through 5. Here, a positive voltage is applied from the power source section 32 to the conductive layer 26 of the transfer drum 11.

First, the process for attracting the transfer material P is explained. The dielectric layer 27 is charged through the semiconductive roller 12 mainly by Paschen discharge and implanting of electric charges. As shown in FIG. 3, the transfer material P transported to the transfer drum 11 is pressed against the surface of the dielectric layer 27 by the semiconductive roller 12. As a result, electric charges stored in the conductive layer 26 move to the dielectric layer 27, and positive charges are induced to the contact surface of the dielectric layer 27 with the conductive layer 26. Then, a distance between the semiconductive roller 12 and the dielectric layer 27 of the transfer drum 11 becomes narrow, and as the strength of the electric field applied to the contact portion between the dielectric layer 27 and the semiconductive roller 12 (nip) becomes stronger, air dielectric breakdown occurs, and thus the Paschen discharge takes place. As a result, negative charges are induced to the surface of the transfer drum 11 (i.e. the contact surface on which the dielectric layer 27 is in contact with the transfer material P), and positive charges are induced to the inner side of the transfer material P (i.e. the contact surface with the dielectric layer 27). Moreover, after the discharge, electric charges are injected into the nip between the semiconductive roller 12 and the transfer drum 11, and negative charges are induced to the outer side of the transfer material P (i.e. the side in contact with the semiconductive roller 12).

Namely, the Paschen discharge is a discharge phenomenon which occurs from the side of the transfer drum 11 to the side of the semiconductive roller 12 in area (I) as shown in FIG. 5 due to the air dielectric breakdown which occurs as the semiconductive roller 12 comes closer to dielectric layer 27 of the transfer drum, the strength of the electric field to be applied to the nip between the dielectric layer 27 and the semiconductive roller 12 becomes stronger.

In addition, the injection of electric charges is an operation for injecting electric charges from the side of the semiconductive roller 12 to the side of the transfer drum 11 in the nip between the semiconductive roller 12 and the transfer drum 11, in area (II) after the discharge.

In such a manner, positive charges are induced to the inner side of the transfer material P by the Paschen discharge and the injection of electric charges in response to the Paschen discharge. Then, the transfer material P is electrostatically attracted to the transfer drum 11 by an attracting force experienced by the electric charges due to the positive applied voltage from the power source section 32 and the negative charges on the outer side of the transfer material P. This attracting force is not diffused as long as the applied voltage is stable, so the transfer material P can be attracted to the transfer drum 11 stably. Moreover, the surface of the transfer drum 11 is uniformly charged by rotation of the semiconductive roller 12 and the transfer drum 11.

Then, the transfer material P, which is attracted to the transfer drum 11 and whose outer side is charged negatively, is transported to a transfer point X of a toner image according to the rotation of the transfer drum 11 in the direction of an arrow.

The following explains the transferring process on the transfer material P. As shown in FIG. 4, toner having negative charges is attracted to the surface of the photoreceptor drum 15. Therefore, when the transfer material P whose surface is charged negatively is transported to the transfer point X, the toner on the photoreceptor drum 15 moves onto the transfer material P by the attracting force experienced by a positive voltage applied from the power source section 32 to the conductive layer 26. Namely, when the transfer material P whose surface is charged negatively is transported to the transfer point X, it is seems that repulsive force is experienced by the transfer material P and the toner on the photoreceptor drum 15. However, attracting force, which cancels the repulsive force produced between the transfer material P and the toner on the photoreceptor drum 15, is produced by the power source section 32. As a result, the toner image is transferred onto the transfer material P.

The transfer drum 11 and the photoreceptor drum 15 are brought into contact with each other by pressure so that a predetermined nip width is obtained at the transfer point X. For this reason, the nip width influences transfer efficiency, i.e. image quality.

The relationship between the nip width and the image quality is shown in Table 1.

TABLE 1

| Nip width | 1 | 2 | 3 | 4 | 5 | 6 | 7 | 8 | 9 | 10 |
|---|---|---|---|---|---|---|---|---|---|---|
| Image quality | x | Δ | ○ | ○ | ○ | ○ | Δ | x | x | x |
| | unsatisfactory transfer <——————> printing blots, etc. | | | | | | | | | |

unit: mm

○: satisfactory transfer,
Δ: normal transfer,
x: unsatisfactory transfer

According to the results of TABLE 1, the satisfactory image quality can be obtained by setting the nip width in a range between 2 mm and 7 mm, and more preferably, in a range between 3 mm and 6 mm.

In addition, if volume resistivity of the semiconductive roller 12 is too low, a voltage drop occurs before the transfer material P reaches the transfer point X. Namely, if the volume resistivity of the semiconductive roller 12 is too low, a lot of electric charges move from the conductive layer 26 to the semiconductive roller 12 because the semiconductive roller 12 is grounded, and thus the voltage drop occurs. When the voltage drop occurs, the adhesion force of the transfer material P is lowered. In order to prevent the voltage drop is prevented, the semiconductive roller 12 is arranged to have a predetermined volume resistivity.

The relationship between the volume resistivity of the semiconductive roller 12 and the image quality is shown in Table 2.

TABLE 2

| Volume resistivity | $10^5$ | $10^6$ | $10^7$ | $10^8$ | $10^9$ | $10^{10}$ | $10^{11}$ | $10^{12}$ | $10^{13}$ | $10^{14}$ |
|---|---|---|---|---|---|---|---|---|---|---|
| Image quality | x | Δ | Δ | ○ | ○ | ○ | Δ | x | x | x |
| | Back-transfer <——————> satisfactory transfer | | | | | | | | | |

unit: Ω · cm

○: satisfactory transfer,
Δ: normal transfer,
x: unsatisfactory transfer

According to the results of Table 2, when the volume resistivity of the semiconductive roller 12 is smaller than $10^6$ Ω·cm, the resistance value is too low. For this reason, excessive currents flow between the photoreceptor drum 15 and the transfer drum 11 at the time of the toner transfer. As a result, a current component, which flows by a circuit having a point of contact to which the Ohm's law is applicable, is given priority in flowing between the photoreceptor drum 15 and the transfer drum 11 to a current component which flows when the toner on the photoreceptor drum 15 moves to the transfer material P. Therefore, the toner cannot move to the transfer material P. Namely, when the volume resistivity of the semiconductive roller 12 is smaller than $10^6$ Ω·cm, the toner is back-transferred.

Meanwhile, when the volume resistivity of the semiconductive roller 12 is larger than $10^{11}$ Ω·cm, the resistant value is too high. For this reason, both the above-mentioned current components difficultly flow between the photoreceptor drum 15 and the transfer drum 11. As a result, since the toner cannot move to the transfer material P, namely, the toner is transferred unsatisfactorily. Therefore, it is not preferable that the volume resistivity is larger than $10^{11}$ Ω·cm. Moreover, it is more preferable that the volume resistivity fall within a range between $10^8$ Ω·cm and $10^{10}$ Ω·cm.

In addition, when the volume resistivity of the dielectric layer 27 is too low, similarly to the semiconductive roller 12, a voltage drop occurs due to the semiconductive roller 12 provided to an adhesion starting point of the transfer material P before the transfer material P reaches the transfer point X. Namely, when the volume resistivity of the dielectric layer 27 is too low, a lot of electric charges moves from the conductive layer 26 to the semiconductive roller 12 because the semiconductive roller 12 is grounded. As a result, the voltage drop occurs. When the voltage drop occurs, the adhesion force of the transfer material P is lowered. For this reason, in order to prevent the voltage drop, the dielectric layer 27 is arranged to have a predetermined volume resistivity so that the dielectric layer 27 function as a capacitor.

The relationship between the volume resistivity of the dielectric layer 27 and the image quality is shown in Table 3.

TABLE 3

| Volume resistivity | $10^8$ | $10^9$ | $10^{10}$ | $10^{11}$ | $10^{12}$ | $10^{13}$ | $10^{14}$ | $10^{15}$ | $10^{16}$ |
|---|---|---|---|---|---|---|---|---|---|
| Image quality | x | Δ | Δ | ○ | ○ | ○ | Δ | Δ | x |
| | Back-transfer <——————> Unsatisfactory transfer | | | | | | | | |

unit: Ω · cm

○: satisfactory transfer,
Δ: normal transfer,
x: unsatisfactory transfer

According to the results of Table 3, when the resistivity of the dielectric layer is smaller than $10^9$ Ω·cm, the resistance value is too low, so excessive currents flow between the photoreceptor drum 15 and the transfer drum 11 at the time of the toner transfer. As a result, a current component, which flows between the photoreceptor drum 15 and the transfer drum 11 by a circuit having a point of contact to which the Ohm's law is applicable, is given priority to a current component which flows when the toner on the photoreceptor drum 15 moves to the transfer material P. Therefore, the toner cannot move to the transfer material P. Namely the volume resistivity of the dielectric layer 27 is smaller than $10^9$ Ω·cm, the toner is back-transferred.

Meanwhile, when the volume resistivity of the dielectric layer 27 is larger than $10^{15}$ Ω·cm, the resistance value is too high. For this reason, both the above-mentioned current component which flows between the photoreceptor drum 15 and the transfer drum 11 by the circuit having a point of contact to which the Ohm's law is applicable and the current component which flows when the toner on the photoreceptor drum 15 transfers onto the transfer material P difficultly flow. As a result, the toner cannot move to the transfer material P. Namely, when the volume resistivity of the dielectric layer is larger than $10^{15}$ Ω·cm, unsatisfactory transfer occurs.

In addition, it is more preferable that the volume resistivity of the dielectric layer 27 falls within a range between $10^{11}$ Ω·cm and $10^{13}$ Ω·cm.

In general, since a type of the transfer material P is different, an amount of charged electric charges (charging potential) on the transfer material P for a time required for a predetermined position of the transfer material P to pass the nip width between the semiconductive roller 12 and the transfer drum 11, namely, for a nip time is different.

The following describes a relationship between a type of the transfer material (paper type) and an amount of charged electric charges (charging potential) on reference to FIGS. 6 through 9.

Figure 6:
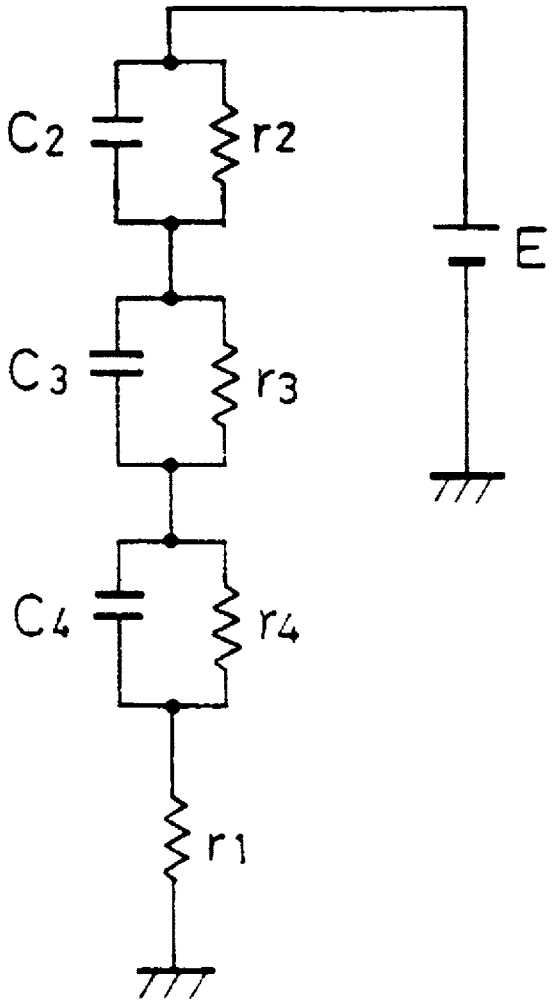
FIG. 6 is an equivalent circuit which shows an electric charge injecting mechanism between the transfer drum and the semiconductor roller shown in FIG. 1.

FIG. 6 shows an equivalent circuit showing an electric charge injecting mechanism after the Paschen discharge, and the electric charge injection corresponds to that electric charges are stored in the capacitor by the currents flowing in the circuit. Namely, E represents an applied voltage to be applied from the power source section 32 to the conductive layer 26, r1 represents resistance of the semiconductive layer 12, r2 represents resistance of the dielectric layer 27, r3 represents resistance of the transfer material P, and r4 represents contact resistance between the semiconductive roller 12 and the transfer material P. Moreover, C2 represents electrostatic capacity of the dielectric layer 27, C3 represents electrostatic capacity of the transfer material P, and C4 represents electrostatic capacity of the nip between the semiconductive roller 12 and the transfer material P.

In order to find the amount of charges accumulated in C3, when the amount of charges (electric potential) given by Paschen discharge is set as an initial electric potential, a potential difference across the electric potential in C3 in the above equivalent circuit is found, and a charging potential is found by taking the Paschen discharge and charge injection into account. The analytic equation of a final electric potential (V3) of the transfer material P thus found is as follows:

$$V3\alpha\times(\beta\times e^{B}-\gamma\times e^{C}) \quad (1)$$

In the equation (1), α, β, γ, B and C represent constants depending on the circuit.

Figure 7:
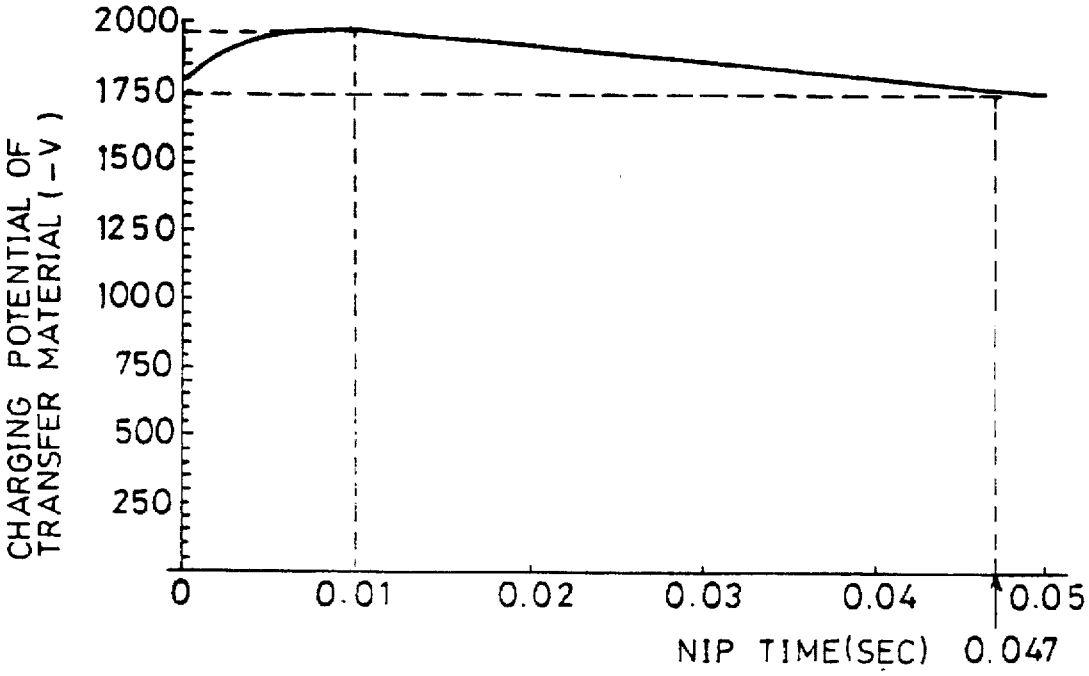
FIG. 7 is a graph which shows a relationship between a charging potential and nip time of the transfer material transported between the transfer drum and the semiconductor roller shown in FIG. 1.

Here, the resistance value (volume resistivity) of the semiconductive roller 12 is $10^7$ Ω·cm, the resistant value (volume resistivity) of the dielectric layer 27 is $10^9$ Ω·cm, the applied voltage is 3.0 KV and paper is used as the transfer material P. FIG. 7 is a graph showing the relationship between the nip time and an amount of electric charges (charging potential) of the transfer material P when the amount of charges injected during the nip time is found based upon the analytic equation (1). The graph in FIG. 7 reveals that the amount of charges (charging potential) of the transfer material P reaches its maximal value over the nip time.

For example, let the rotation speed of the transfer drum 11, be 85 mm/sec., and the nip width between the transfer drum 11 and the semiconductive roller 12 be 4 mm, then the nip time becomes 0.047 sec. It is found from the results of FIG. 7 that the amount of charges of the transfer material P is reduced to −1740 V the initial amount of −1800 V when the nip time of 0.047 sec. has passed, meaning that the electrostatic adhesion of the transfer material P becomes weaker.

In this case, in order to make the amount of charges (charging potential) after the charge injection at least as large as the initial amount of charges (charging potential), the nip time is adjusted by narrowing the nip width between the transfer drum 11 and the semiconductive roller 12 to be shorter than 4 mm (for example, 3 mm) or by increasing the rotation speed of the transfer drum 11 to be faster than 85 m/sec (for example, 95 mm/sec). Further, in order to enhance the efficiency of the injection of charges, the nip width between the transfer drum 11 and the semiconductive roller 12 is adjusted or the rotation speed of the transfer drum 11 is adjusted so that the electric charges are injected when the amount of charges (charging potential) of the transfer material P reaches its maximal value (at the nip time of 0.01 sec.). In this case, the nip width is 0.85 mm and the rotation speed of the transfer drum 11 is 300 mm/sec.

Thus, when the amount of charges (charging potential) of the transfer material P reaches its maximal value over the nip time, the transfer material P can electrostatically adhere to the dielectric layer 27 of the transfer drum 11 stably by setting the nip time in such a manner that the amount of charges of the transfer material P will not drop below the initial amount of charges (charging potential). Moreover, if the nip time corresponding to the maximal value of the charging potential is set as a nip passing time, the charges are injected efficiently by, and thus, the transfer material P can be charged more efficiently. As a result, the transfer material P can electrostatically adhere to the dielectric layer 27 more stably.

Figure 8:
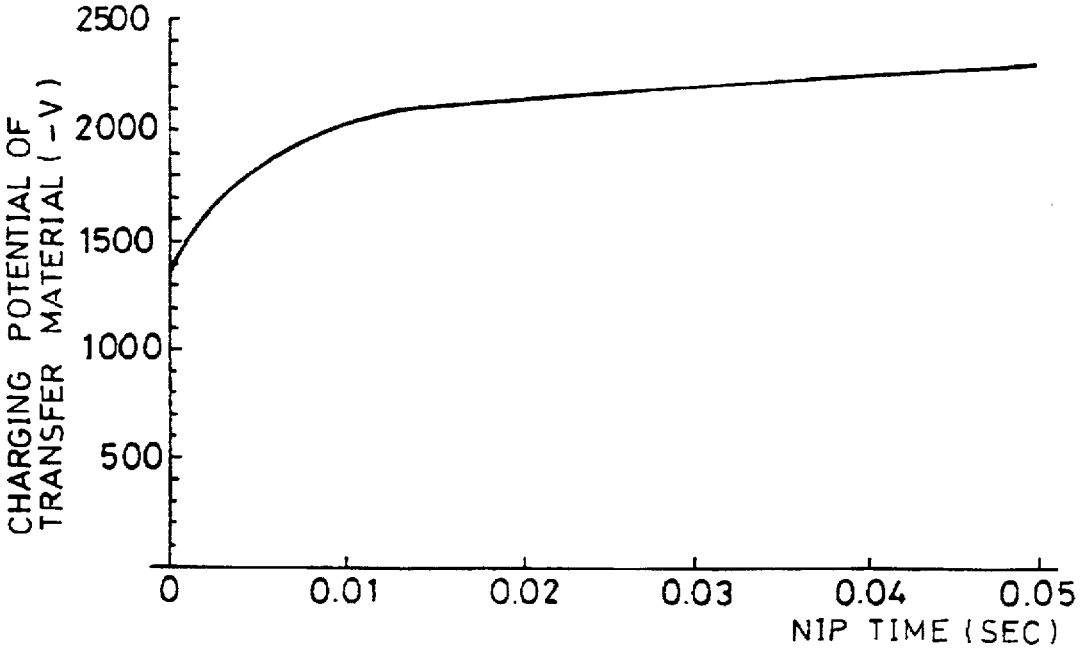
FIG. 8 is a graph which shows a relationship between the charging potential and the nip time of the transfer material in a different condition from FIG. 7.

In addition, FIG. 8 is a graph showing the relationship between the nip time and the amount of electric charges (charging potential) of the transfer material P when the amount of electric charges injecting during the nip time is found based upon the above analytic equation under the same conditions except that an OHP sheet of a synthetic resin is used as the transfer material P (the resistant value (volume resistivity) of the semiconductive roller 12 is $10^7$ Ω·cm, the resistant value (volume resistivity) of the dielectric layer 27 is $10^9$ Ω·cm, and the applied voltage is 3.0 KV).

The graph in FIG. 8 reveals that the amount of electric charges (charging potential) of the transfer material P tends to increase as the nip time extends when the transfer material P is the OHP sheet of the synthetic resin.

Figure 9:
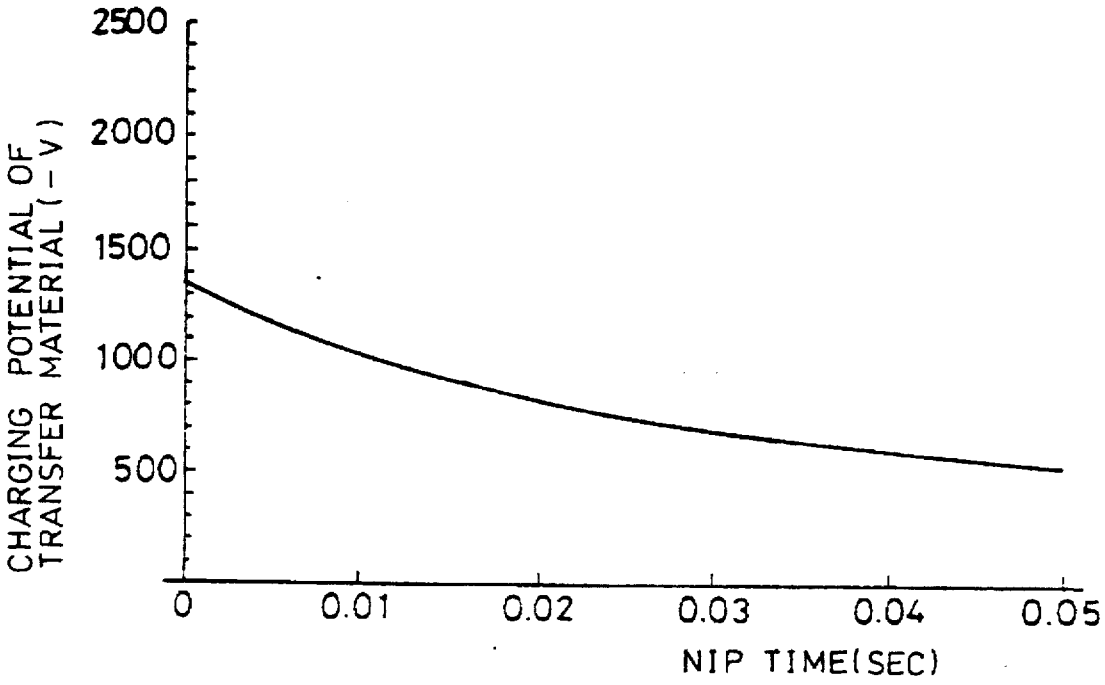
FIG. 9 is a graph which shows a relationship between the charging potential and the nip time of the transfer material in a different condition from FIGS. 7 and 8.

In addition, the resistance value (volume resistivity) of the semiconductive roller 12 is $10^9$ Ω·cm, the resistant value (volume resistivity) of the dielectric layer 27 is $10^{10}$ Ω·cm, the applied voltage is 3.0 KV and paper is used as the transfer material P. FIG. 9 is a graph showing the relationship between the nip time and the amount of electric charges (charging potential) when the amount of charges injected during the nip time is found based upon the above analytic equation.

According to the results, in the case where the transfer material P is paper, when the resistance values of the semiconductive roller 12 and the conductive layer 28 are set to be higher, no charges are inject after passing the nip width. Therefore, it is found that the amount of electric charges (charging potential) of the transfer material P tends to decrease more than the initial amount of electric charges (charging potential) as the nip time extends. The relationship between a percentage of the charging potential after the injection of the electric charges to before the injection of the electric charges and the adhesion effect is shown in Table 4.

TABLE 4

| Percentage of charging potential (after/before) | 10 or less | 20 | 30 | 40 | 50 | 60 | 70 | 80 | 90 or more |
|---|---|---|---|---|---|---|---|---|---|
| Adhesion effect | x | x | x | x | o | o | o | o | o |

Unit: %

In Table 4, a mark "o" indicates that the adhesion effect is excellent, and the transfer material P electrostatically adheres to the transfer drum 11 stably while the transfer drum 11 rotates four times (the toner images in four colors are transferred onto the transfer material P). Moreover, a mark "x" indicates that the adhesion effect is nil, and the transfer material P is separated from the transfer drum 11 while the transfer drum 11 rotates four times.

According to the results in Table 4, it is found that if the charging potential (amount of electric charges) after the charge injection is 50% or more of the initial potential (initial amount of electric charges) before the charge injection, the transfer material P can electrically adhere to the transfer drum 11 stably while the transfer drum 11 rotates four times.

The nip time is set to 0.01 sec., for example, so that the amount of electric charges (charging potential) of the transfer material P becomes not less than 50% of the initial amount of electric charges (charging potential). At this time, the nip width is set to 0.85 mm, or the rotation speed of the transfer drum 11 is set to 300 mm/sec.

In addition, the type of the transfer material P, the physical property (volume resistivity) of the semiconductive roller 12, the physical property (volume resistivity) of the dielectric layer 27 and the applied voltage were variously changed so that experiments were made. According to the experiments, it was confirmed that the tendency in the graph showing the relationship between the nip time and the amount of electric charges (charging potential) of the transfer material P corresponds to graphs of FIGS. 7 or 9.

As shown in the graphs, even if the physical property (resistance) of the semiconductive roller 12, the physical property (resistance) of the dielectric layer 27, the applied voltage or the type of the transfer material P is charged, the relationship between the nip time and the amount of electric charges (charging potential) of the transfer material P can be roughly classified into three patterns specified below:

- a pattern that the amount of electric charges (charging potential) of the transfer material P has its maximal value as the nip time changes;
- a pattern that the amount of electric charges (charging potential) of the transfer material P increases as the nip time becomes longer; and
- a pattern that the amount of electric charges (charging potential) of the transfer material P decreases as the nip time becomes longer.

For this reason, the relationship between the amount of electric charges (charging potential) of each kind of transfer material P and the nip time in the case where a arbitrary semiconductive roller 12, dielectric layer 27, etc. are used is previously obtained. As a result, the charges can be injected efficiently by changing the nip time according to the types of the transfer material P to be used, thereby making the transfer material P electrostatically adhere to the dielectric layer 27 stably.

The detection of the types of the transfer material P (paper type) can be made by visual inspection, but a transfer material detecting sensor (detecting means) 33 shown in FIG. 1 can be used. The transfer material detecting sensor 33 is positioned on an upstream side above the PS rollers 10 in the transporting direction of the transfer material P, and it is connected to control means, not shown. The transfer material detecting sensor 33 determines the physical property of the transfer material P to be transported to the transfer drum 11 by means of the control means before the transfer material P adheres to the transfer drum 11 so as to detect a type of the transfer material P. Namely, the transfer material detecting sensor 33 measures transmittance, for example, so as to detect a type of the transfer material P (paper or an OHP sheet of the synthetic resin), and measures, for example, the thickness of the transfer material P so as to detect a type of the transfer material P (for example, thick paper or thin paper) Then, the nip time is adjusted according to the type of the detected transfer material P (for example, paper or an OHP sheet of a synthetic resin, or the thickness of the transfer material P).

The nip time is determined according to <nip width between the transfer drum 11 and the semiconductor roller 12/the rotation speed of the transfer drum 11>. Since the semiconductive roller 12 is made of a semiconductive body having elasticity such as urethane foam, the nip width can be easily adjusted by changing contact pressure between the transfer drum 11 and the semiconductive roller 12, for example.

Figure 10:
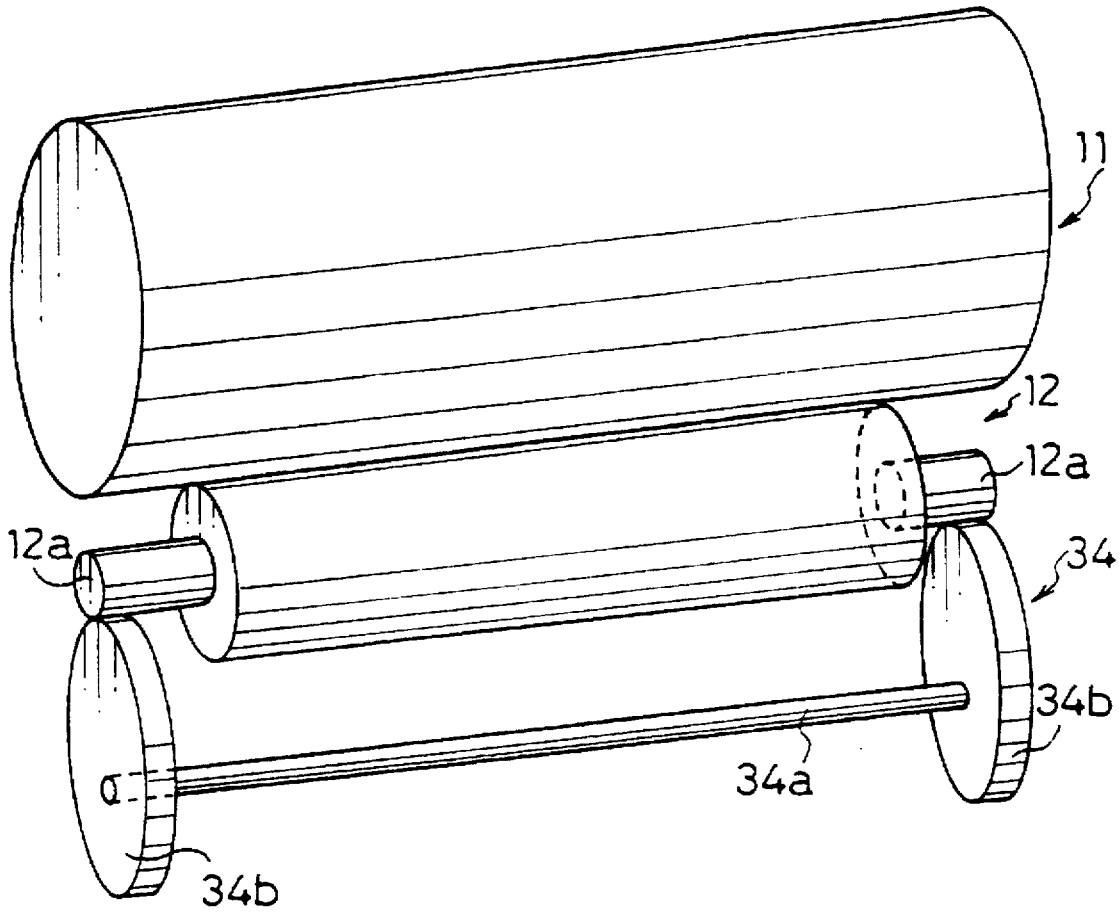
FIG. 10 is an explanatory drawing which shows an arrangement for changing contact pressure between the transfer drum and the semiconductor roller shown in FIG. 1.

For example, contact pressure changing means (nip width adjusting means) shown in FIG. 10 including an eccentric cam 34 for pressing the semiconductive roller 12 is provided below the semiconductive roller 12 and the eccentric cam 34 adjusts the force for pressing the semiconductive roller 12 so that the contact pressure between the transfer drum 11 and the semiconductive roller 12 can be changed. The eccentric cam 34 is composed of a shaft (center) **34*a* and pressing members 34*b* made of elliptic flat boards provided on both ends of the shaft 34*a*. The eccentric cam 34 is positioned so that the pressing members 34*b* is in contact with a rotation shaft 12*a* of the semiconductive roller 12. The shaft 34*a* supports the pressing members 34*b* in an off-centered position of the pressing member 34*b*, and it is positioned so as to be parallel with the semiconductive roller 12**.

Figure 11:
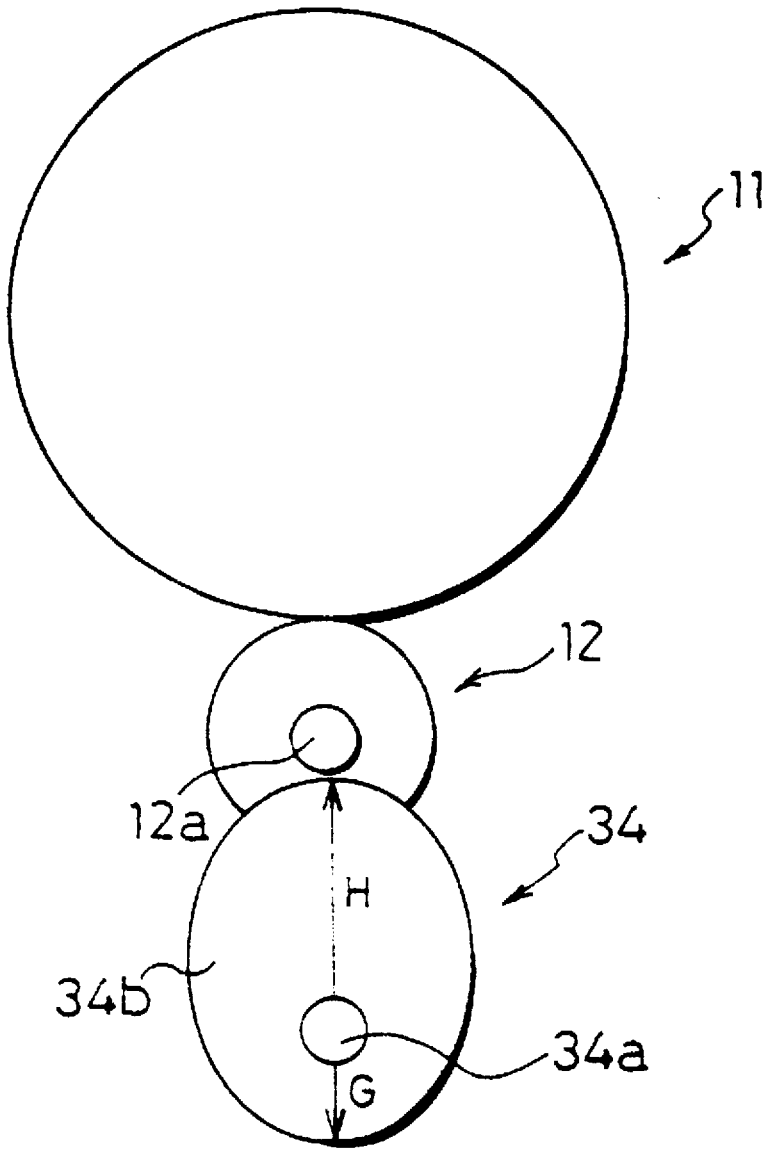
FIG. 11 is an explanatory drawing which shows an arrangement for changing the contact pressure between the transfer drum and the semiconductor roller shown in FIG. 10 from a side of an electrically conductive roller.

As shown in FIG. 11 showing side view of the transfer drum 11, the semiconductive roller 12 and the eccentric cam 34 from the side, the contact pressure between the transfer drum 11 and the semiconductive roller 12 becomes maximum when the distance between the shaft **34*a* is separated from the rotation shaft 12*a* farthest (in FIG. 11, the distance between the shaft 34*a* and the rotation shaft 12*a* is H), and the contact pressure becomes minimum when the shaft 34*a* is closest to the rotation shaft 12*a* (in FIG. 11, the distance between the shaft 34*a* and the rotation shaft 12*a* is G). As a result, when the eccentric cam 34 is rotated, the force of the eccentric cam 34 for pressing the semiconductive roller 12 is adjusted, thereby adjusting the contact pressure between the transfer drum 11 and the semiconductive roller 12**.

As mentioned above, since the semiconductive roller 12 is made of a semiconductive body having elasticity, even if the type of the transfer material P is changed, the nip width, namely, the nip time can be easily changed without lowering the transfer efficiency by making the rotation speed of the transfer drum 11 constant so as to change the contact pressure between the transfer drum 11 and the semiconductive roller 12. As a result, the injecting amount of electric charges can be easily controlled, thereby the transfer material P can be made electrostatically adhere to the dielectric layer 27 stably. Therefore, toner can be satisfactorily transferred from the photoreceptor drum 15 to the transfer drum 11 without removing the transfer material P from the transfer drum 11 before the toner images in each color formed on the photoreceptor drum 11 are completely transferred to the transfer material P, thereby providing the stable images.

Furthermore, when the nip width between the transfer drum 11 and the semiconductive roller 12 is made constant, and the rotation speed of the transfer drum 11 is made changeable by using control means, not shown, as nip time changing means, the nip time can be adjusted. However, in the case where the nip time is changed by the rotation speed of the transfer drum 11, it is required for increasing the nip time to decrease the rotation speed of the transfer drum 11. For this reason, in the case where the nip time is adjusted by changing the rotation speed of the transfer drum 11, the transfer efficiency is possibly lowered due to the decrease in the rotation speed of the transfer drum 11. Accordingly, it is preferable that the nip time is changed by adjusting the contact pressure between the transfer drum 11 and the semiconductive roller 12.

As mentioned above, the transfer material detecting sensor 33 detects a type of the transfer material P, and the relationship between the nip time and the amount of electric charges (charging potential) of the transfer material P is obtained so as to be stored in storage means such as ROM. When the control of the eccentric cam 34 changes the contact pressure between the transfer drum 11 and the semiconductive roller 12 according to the above relationship, the transfer material P can be made electrostatically adhere to the transfer drum 11 stably so that the nip time can be automatically changed.

The following describes the image forming process in the image forming apparatus having the above arrangement on reference to FIGS. 2 through 4.

First, as shown in FIG. 2, in the case of automatic feeding, the transfer materials P (see FIG. 3) on the feed cassette 5 provided to lowest part of the main body are successively fed from the topmost one to the PF rollers 8 by the pick up roller 7. The transfer materials P which pass the PF rollers 8 are curled along the surface of the transfer drum 11 by the PS rollers 10.

Meanwhile, in the case of manual feeding, when the transfer materials P are fed from the manual feed section 6 provided to the front of the main body one by one, the transfer materials P are fed to the PS rollers 10 by the manual rollers 9. Then, the transfer materials P are curled along the surface of the transfer drum 11 by the PS rollers 10.

As shown in FIG. 3, the curled transfer materials P are fed between the transfer drum 11 and the semiconductive roller 12. Then, the Paschen discharge from the transfer drum 11 to the semiconductive roller 12 takes place. After the discharge, electric charges are injected between the semiconductive roller 12 and the transfer drum 11, and the electric charges are induced on the surface of the transfer material P. As a result, the transfer material P electrostatically adheres to the surface of the transfer drum 11.

Thereafter, as shown in FIG. 4, the transfer material P adhering to the transfer drum 11 is fed to the transfer point X which is a pressure-contact portion between the transfer drum 11 and the photoreceptor drum 15, and the toner images are transferred onto the transfer material P by a potential difference between electric charges of the toner formed on the photoreceptor drum 15 and electric charges induced by a voltage applied from the power source section 32.

At this time, charging, exposing, developing and transferring processes per color are performed on the photoreceptor drum 15. Therefore, the transfer material P is rotated with the transfer drum 11 adhering to the transfer drum 11, and the toner image in one color is transferred to the transfer material P by one rotation. Therefore, one image in full colors can be obtained by maximumly four rotations. However, in the case where a monochrome image or a mono-color image is required, only one rotation of the transfer drum 11 is required.

In addition, when all the toner images are transferred onto the transfer material P, the transfer material P is forcibly separated from the surface of the transfer drum 11 by the separating claw 14, which is provided on the circumference of the transfer drum 11 so as to be freely attachable to and detachable from the transfer drum 11, and the transfer material P is guided to the fixing guide 22.

Thereafter, the transfer material P is guided to the fixing rollers 23 by the fixing guide 22, and the toner images are fused and fixed on the transfer material P by the temperature and pressure of the fixing rollers 23.

Then, the transfer material P on which the toner images have been fixed is discharged onto the discharge tray 25 by the discharge roller 24.

As mentioned above, the transfer drum 11 is composed of the conductive layer 26 made of aluminum provided on the inner side and the dielectric layer 27 made of PVDF provided on the outer side. As a result, when a voltage is applied to the conductive layer 26, electric charges are induced from the conductive layer 26 and the electric charges are stored on the dielectric layer 27. When the transfer material P is fed between the transfer drum 11 and the semiconductive roller 12 made of urethane foam, the Paschen discharge from the transfer drum 11 to the semiconductive roller 12 takes place. After the completion of the discharge, electric charges are injected from the semiconductive roller 12 to the transfer drum 11. As a result, positive charges are induced to the inner surface of the transfer material P. Then, the transfer material P electrostatically adheres to the transfer drum 11 by the attracting force between electric charges due to a positive voltage applied from the power source section 32 and negative electric charges on the outer surface of the transfer material P.

Therefore, unlike the conventional method, the adhesion and transferring on the transfer material P are not executed by the injection electric charges by atmospheric discharge. Since the adhesion and transferring on the transfer material P are executed by the injection of electric charges by partial discharge in a minute void, a low voltage can be used, and the voltage can be easily controlled. Moreover, dispersion of a voltage due to circumferential environment can be eliminated, an occurrence rate of ozone is comparatively low.

As a result, since the voltage applied to the transfer drum 11 is not influenced by environment such as humidity and temperature, the voltage can be kept constant. Therefore, the transfer efficiency and the image quality can be improved.

In addition, since the voltage may be applied to only one portion, it is not necessary to apply a voltage to each charger unlike the conventional method. As a result, the device can be simplified, and cost of the manufacture can be low.

In addition, since the transfer drum 11 is charged by contact charging, even if the surface of the transfer drum 11 is scratched, a domain of an electric field does not change. For this reason, the electric field is not imbalanced on the scratched portion of the surface of the transfer drum 11. As a result, the transfer efficiency can be improved.

In addition, since the above image forming apparatus is capable of charging the surface of the transfer drum 11 more stable compared to the conventional case where the surface of the transfer drum 11 is charged by inducing electric charges by atmospheric discharge, the adhesion and transferring on the transfer material P can be executed stably.

Furthermore, since the above image forming apparatus is hardly influenced by environment such as temperature and humidity in the air, the surface potential of the transfer drum 11 is not dispersed, thereby eliminating insufficient adhesion of the transfer material P, irregularity of printing, etc. As a result, the transfer efficiency and image quality can be improved.

When the grounded electrode member as the potential difference generating means is made of a semiconductive body, the nip width can be adjusted more easily, and the charging potential can be adjusted more easily according to the type of the transfer material P. Moreover, when the electrode member is made of a semiconductive body, the transfer material P can electrostatically adhere to the surface of the transfer drum 11 by dynamics as well as the Paschen discharge and the injection of electric charges, thereby executing electrostatic adhesion more stably. Therefore, in the above arrangement, the PS rollers are provided, but the PS rollers 10 is not always required, thereby decreasing members and the cost of manufacture. Moreover, even if the contact pressure is made high in order to provide the nip width, the transfer material P is curled along the transfer drum 11, thereby executing the electrostatic adhesion stably.

When a semiconductive layer is provided between the conductive layer 26 and the dielectric layer 27, for example, the transfer material P electrostatically adheres to the transfer drum 11 by using an electrode roller (conductive roller) having conductivity as the grounded electrode member. However, in this case, the transfer material P is not curled along the whole surface of the transfer drum 11 in the electrostatic adhering portion of the transfer material P (the contact portion between the transfer drum 11 and the grounded electrode roller). For this reason, it is necessary to curl the transfer material P along the transfer drum 11 by providing the PS rollers 10 before the transfer material P adheres to the transfer drum 11. Moreover, in this case, when the contact pressure between the transfer drum 11 and the electrode roller is increased so that the nip width is provided, stronger curling in the opposite direction possibly occurs.

Therefore, when the nip width can be easily adjusted by making the grounded electrode member of the semiconductive body, the nip width can be adjusted more easily. As a result, the charging voltage can be easily controlled according to a type of the transfer material P, and the electrostatic adhesion can be executed more stably. Therefore, the toner transfer is executed from the photoreceptor drum 15 to the transfer drum 11 satisfactorily without separating the transfer material P from the transfer drum 11 before all the toner images in each color formed on the photoreceptor drum 15 are transferred to the transfer material P, thereby always supplying stable images. Moreover, when a voltage is applied to the conductive layer 26, both the electrostatic adhesion of the transfer material P to the transfer drum 11 and the toner transfer from the photoreceptor drum 15 to the transfer material P can be executed, so it is not necessary to use a plurality of power sources. As a result, the apparatus can be arranged at a low price.

In the above embodiment, the cylindrical aluminum is used as the conductive layer 26, but another conductive body may be used. Moreover, the dielectric layer 27 is made of PVDF, but a resin such as polyethylene terephthalate may be used as another dielectric body. Further, the semiconductive roller 12 is made of urethane foam, but a elastic body such as silicon may be used another semiconductive body.

The following are embodiments 2 through 5 as another embodiments of the present invention. The basic arrangements in the following embodiments are the same as embodiment 1, and in each embodiment, parts which are different from embodiment 1 are mainly explained. Moreover, in the following embodiments, those members that have the same arrangement and functions, and that are described in the aforementioned embodiment 1 are indicated by the same reference numerals and the description thereof is omitted.

[EMBODIMENT 2]

Figure 14:
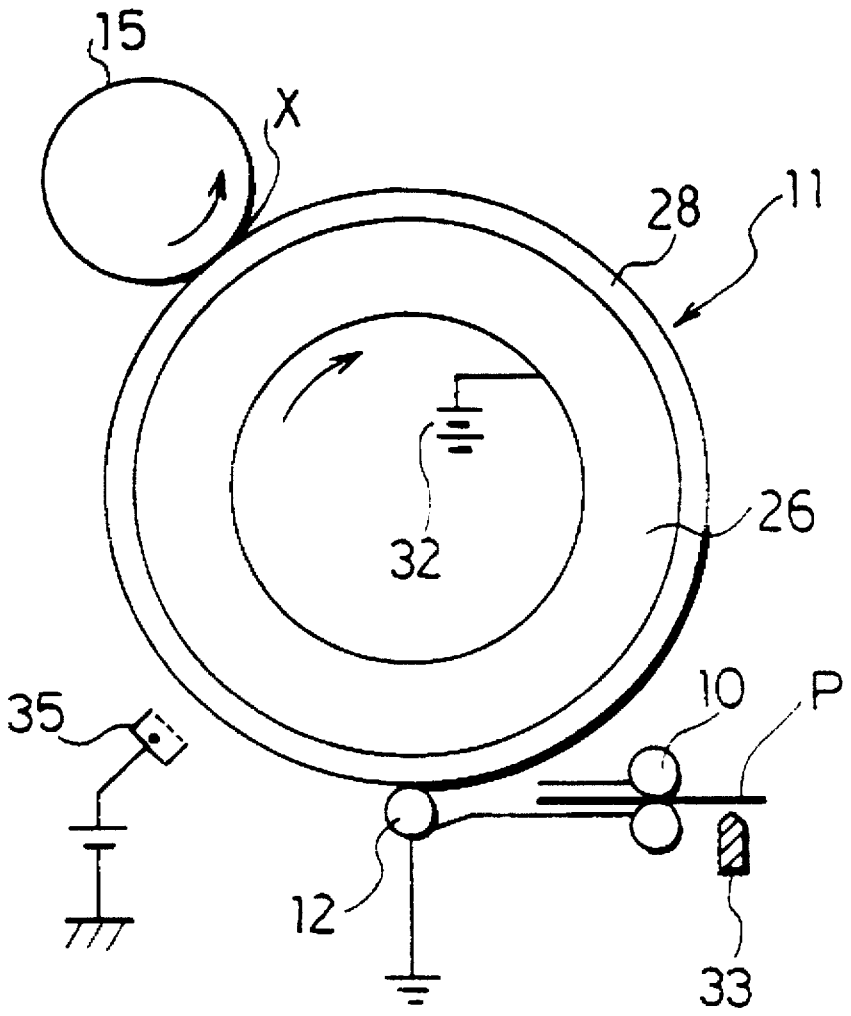
FIG. 14 is a schematic constitutional drawing which shows the proximity of a transfer drum in an image forming apparatus according to embodiment 2 of the present invention.

The following describes another embodiment of the present invention on reference to FIG. 14.

The image forming apparatus of the present embodiment is arranged so as to have a scorotron 35 as corona charging means around the transfer drum 11 shown in FIG. 1 in embodiment 1. The scorotron 35 is provided below the semiconductive roller 12 in the feeding direction of the transfer material P, the electric charges required for the electrostatic adhesion of the transfer material P, which cannot be adjusted by the nip width of the semiconductive roller 12, are covered by giving a constant potential to the transfer material P.

For this reason, the applied voltage to the transfer drum 11 can be controlled by setting the voltage to the most suitable value for the toner transfer. Moreover, the surface potential of the transfer material P is kept constant by the Scorotron 35. Therefore, with the above arrangement, the transfer material P can adhere to the dielectric layer 27 more stably. As a result, satisfactory toner transfer from the photoreceptor drum 15 to the transfer material P can be executed without separating the transfer material P from the transfer drum 11 before all the toner images in each color formed on the photoreceptor drum 15 are transferred to the transfer material P, thereby always supplying the stable image.

[EMBODIMENT 3]

Figure 15:
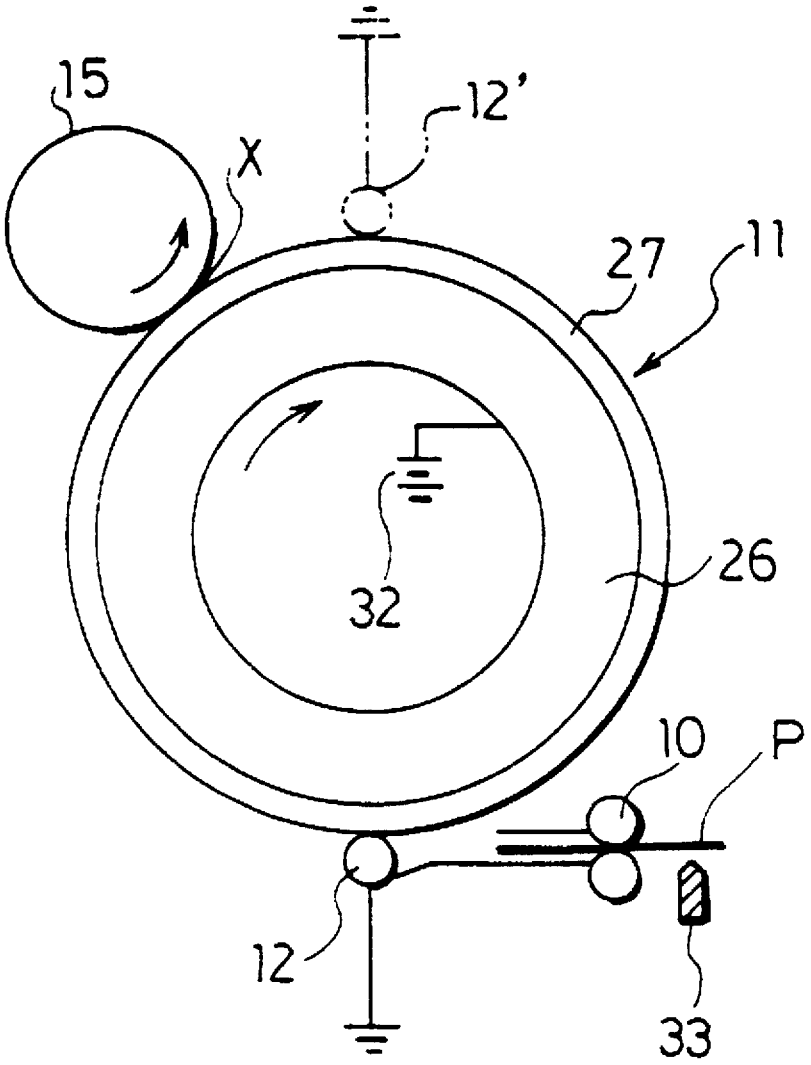
FIG. 15 is a schematic constitutional drawing which shows the proximity of a transfer drum in an image forming apparatus according to embodiment 3 of the present invention.

The following describes still another embodiment of the present invention on reference to FIG. 15. In the present embodiment, the control of an electrostatic adhesion voltage and a toner transfer voltage of the transfer material P are mainly described.

In the image forming apparatus of the present embodiment, the photoreceptor drum 15 and the semiconductive roller 12 are located in a position where the forward end of the transfer material P in the feeding direction is in contact with the photoreceptor drum 15 after the backward end of the transfer material P in the feeding direction passes through the semiconductive roller 12 (namely, a position where when the transfer drum 11 is rotated, the forward end of the transfer material P gets into the nip between the photoreceptor drum 15 and the transfer drum 11 after the backward end of the transfer material P passes through the nip between the semiconductive roller 12 and the transfer drum 11). As a result, in the image forming apparatus of the present embodiment, the applied voltage from the power source section 32 can be switched by voltage switching means in control means (not shown) according to the period of the transfer material P in contact with the semiconductive roller 12 and the period of the transfer material P in contact with the photoreceptor drum 15. Namely, when the transfer is executed, the voltage switching means applies a lower transfer voltage than the adhesion voltage to the conductive layer 26.

As a result, when the above image forming apparatus is used, different voltages from the power source section 32 are used as a voltage required for the electrostatic adhesion of the transfer material P to the conductive layer 26 and a voltage required for the toner transfer. For this reason, the electrostatic adhesion to the dielectric layer 27 and the toner transfer can be executed stably only by using the power source section 32.

More specifically, when an applied voltage for an optimum transfer is represented by E1, and an applied voltage required for making the transfer material electrostatically adhere stably to the dielectric layer 27 is represented by E2 ($E1 \neq E2$), the applied voltage is set to E2 while the transfer material P is in contact with the semiconductive roller 12, and the applied voltage is set to E1 when the transfer material P is in contact with the photoreceptor drum 15 or the toner transfer is executed. As a result, the satisfactory electrostatic adhesion of the transfer material P and toner transfer can be executed by using only the power source section 32. In accordance with the above arrangement, since the voltage may be applied to only one location, it is not necessary to apply the voltage per charger unlike the conventional apparatus, thereby simplifying the apparatus and lowering the cost of the manufacture.

As described above, in order that the forward end of the transfer material P in the feeding direction is brought into contact with the photoreceptor drum 15 after the backward end of the feeding direction of the transfer material P passes through the semiconductive roller 12, a distance from the semiconductive roller 12 to the photoreceptor drum 15 towards the feeding direction of the transfer material P may have a length which is longer than a length of the feeding direction of the transfer material P, i.e. a maximum longitudinal feeding size of the transfer material P. For this reason, for example, the transfer drum 11 can be formed larger, but when the semiconductive roller 12 is located in the proximity of the down stream side of the photoreceptor drum 15 as a semiconductive roller 12' shown by alternate long and two short dashes lines, the above-mentioned length can be obtained without forming the transfer drum 11 larger.

In this case, a distance from the semiconductive roller 12' to the photoreceptor drum 15 towards the feeding direction is made longer than the maximum longitudinal feeding size of the transfer material P, more specifically, when the maximum feeding size of the transfer material is A4, for example, the distance may be made longer than 300 mm, and when A3, longer than 425 mm.

[EMBODIMENT 4]

The following describes another embodiment of the present invention on reference to FIGS. 16 through 29.

Figure 16:
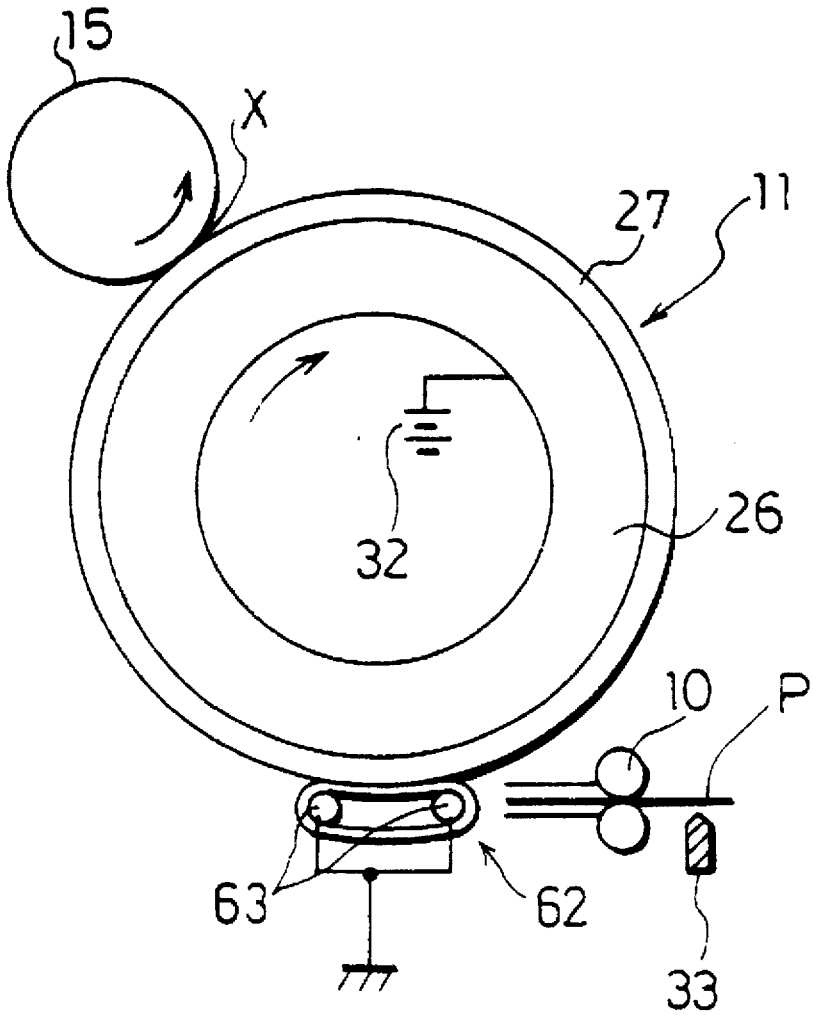
FIG. 16 is a schematic constitutional drawing which shows the proximity of a transfer drum in an image forming apparatus according to embodiment 4 of the present invention.
Figure 17:
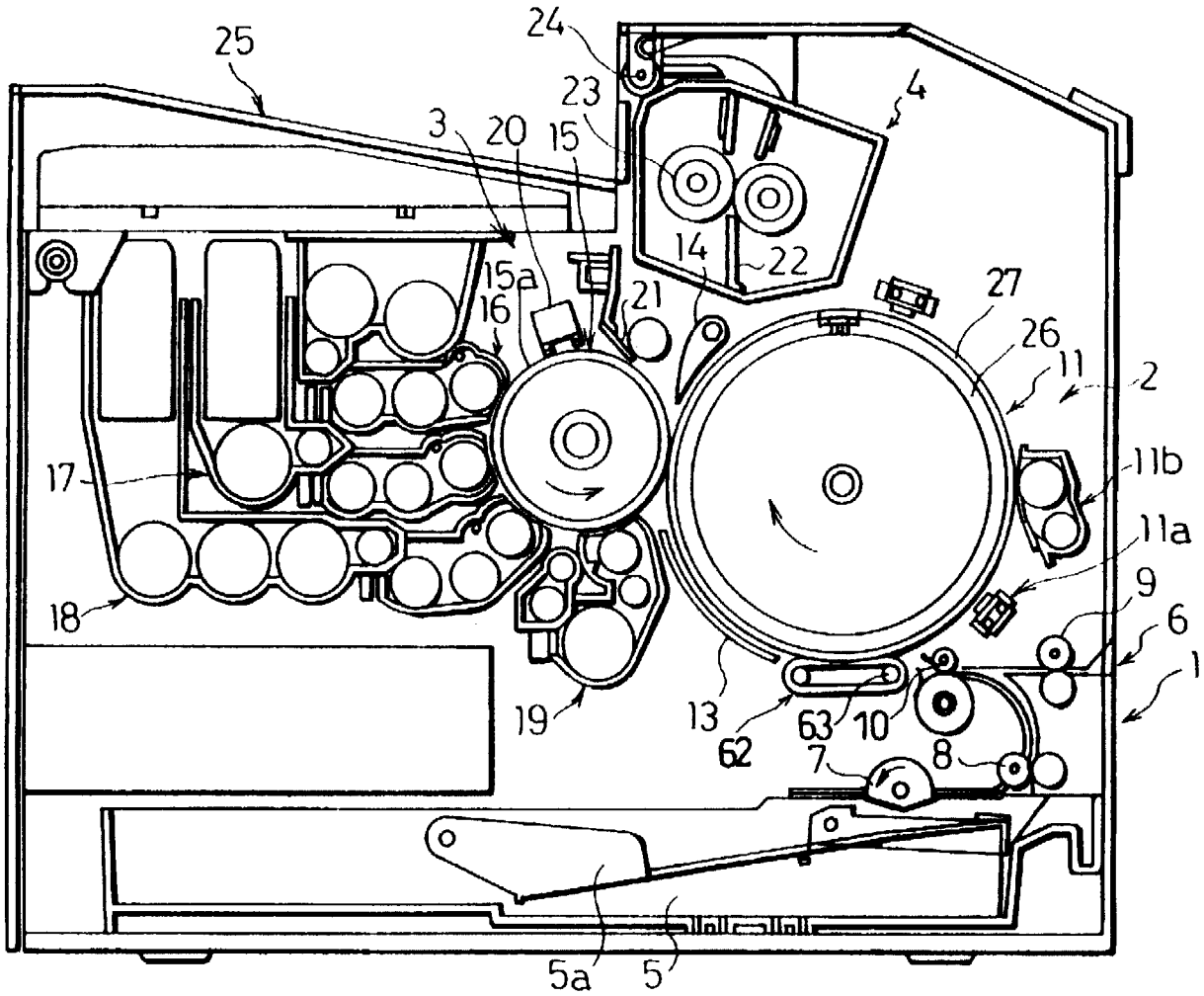
FIG. 17 is a schematic constitutional drawing which shows the image forming apparatus having the transfer drum and a semiconductor belt shown in FIG. 16.

As shown in FIGS. 16 and 17, the image forming apparatus of the present embodiment includes, instead of semiconductive roller 12 shown in FIG. 1 of the above embodiment 1, a semiconductive belt 62 (potential difference generating means) which is in contact with the transfer drum 11 through the transfer material P. The semiconductive belt 62 is a grounded electrode member made of a semiconductive body having elasticity.

Figure 18:
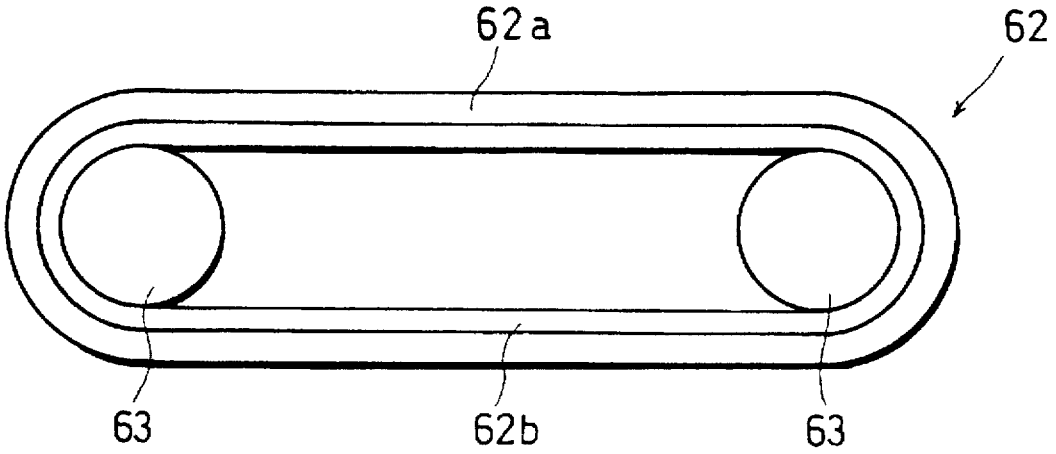
FIG. 18 is a schematic constitutional drawing which shows the semiconductor belt shown in FIG. 16.

As shown in FIG. 18, the semiconductive belt 62 has an arrangement that a metallic thin film layer **62*b* is formed inside the semiconductive layer 62*a*. Urethane foam, for example, is used as the material of the semiconductive layer 62*a*. The semiconductive layer 62*a* is formed such that a beads-like raw material is previously heated so as to be primarily foamed, and this material is allowed to stand/cure/dry and is put into a belt-like metallic mold and heated so as to be secondary foamed. As a result, gaps among grains are filled with foams and fused. The semiconductive belt 62 having the above arrangement is supported by a supporting roller 63**.

As mentioned above, the voltage can be applied stably by providing the metallic thin film layer **62*b* inside the semiconductive layer 62*a*. Here, the metallic thin film 62*b* may be provided outside the semiconductive layer 62*a*, and the material of the metallic thin film 62*b*** is not limited to metal, so any kind of materials can be used as long as such a material is conductive.

Figure 19:
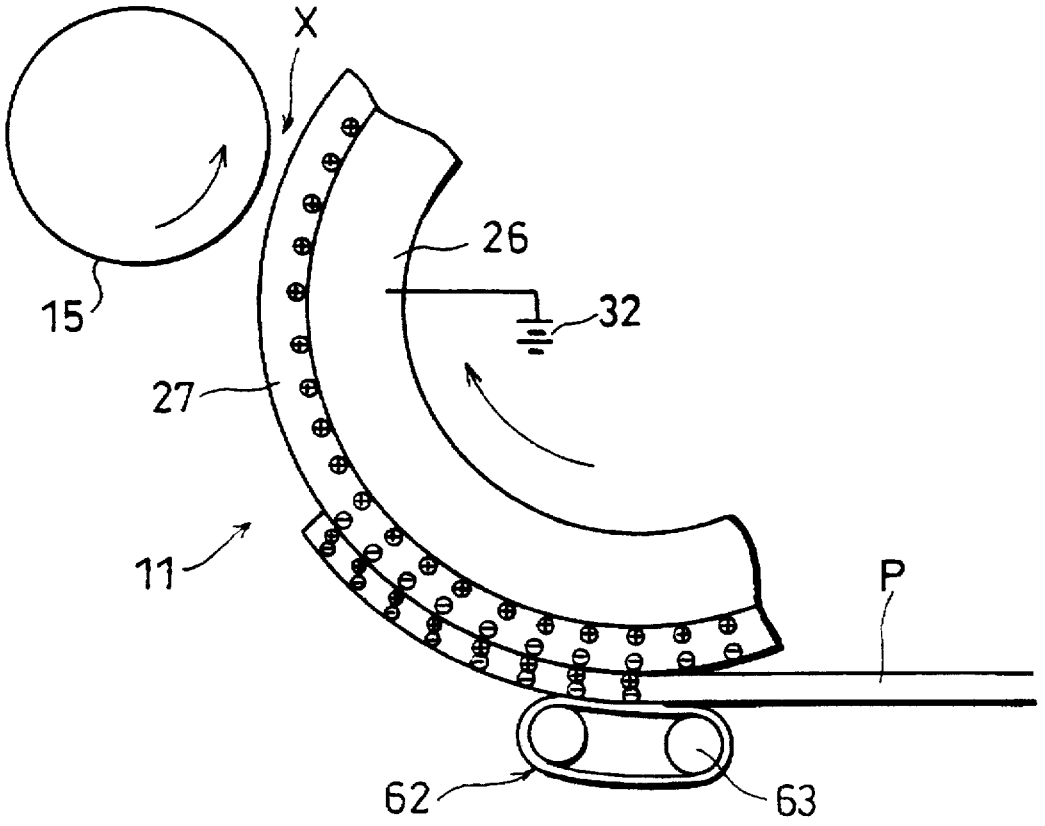
FIG. 19 is an explanatory drawing which shows the transfer drum shown in FIG. 16 in a charging condition, and shows an initial condition where the transfer material is transported to the transfer drum.
Figure 20:
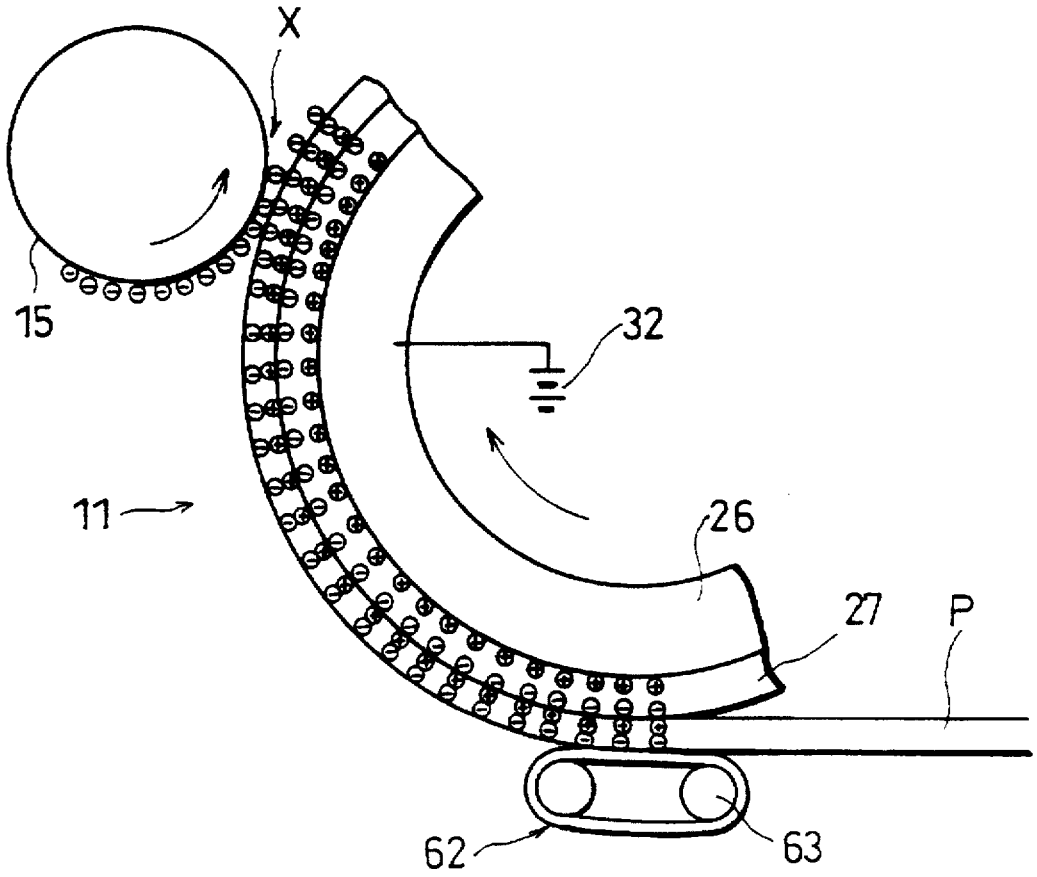
FIG. 20 is an explanatory drawing which shows the transfer drum shown in FIG. 16 in a charging condition, and shows a condition where the transfer material is transported to the transfer position of the transfer drum.
Figure 21:
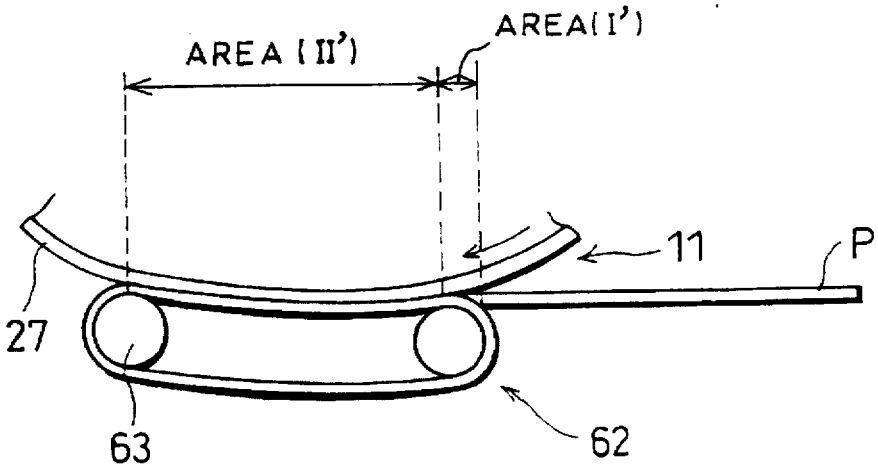
FIG. 21 is an explanatory drawing which shows Paschen's discharge in a close contact portion between the transfer drum and the semiconductor belt shown in FIG. 16.

The following describes adhesion and transfer processes of the transfer material P by means of the transfer drum 11 on reference to FIGS. 19 through 21. A positive voltage is applied to the conductive layer 26 of the transfer drum 11 from the power source section 32. Moreover, the photoreceptor drum 15 and the transfer drum 11 are brought into contact with each other by pressure so that pressure of 2 kg is applied to a transferring portion in order to obtain satisfactory transfer efficiency and image quality.

First, the adhesion process of the transfer material P is described. The electrification of the dielectric layer 27 using the semiconductive belt 62 is executed also by the Paschen discharge and the injection of electric charges.

In this case, the Paschen discharge is a discharge phenomenon which occurs from the side of the transfer drum 11 to the side of the semiconductive belt 62 in an area (I') shown in FIG. 21 due to the air dielectric breakdown which occurs as the semiconductive belt 62 comes closer to the dielectric layer 27 of the transfer drum 11, and the strength of the electric field to be applied to a contact portion between the dielectric layer 27 and the semiconductive belt 62 becomes stronger.

In addition, the injection of electric charges is such that after the discharge, more negative charges are stored on the surface of the transfer drum 11 in a nip between the transfer drum 11 and the semiconductive belt 62, namely, an area (II') shown in FIG. 21.

Namely, as shown in FIG. 19, first, the semiconductive belt 62 brings the transfer material P fed to the transfer drum 11 into contact with the surface of the dielectric layer 27 with pressure. Then, the electric charges stored on the conductive layer 26 shift to the dielectric layer 27, and positive charges are induced on the contact surface of the dielectric layer 27 with the conductive layer 26. Thereafter, when the semiconductive belt 62 comes closer to the dielectric layer 27 of the transfer drum 11 and thus the intensity of an electric field applied to the nip between the dielectric layer 27 and the semiconductive belt 12 becomes stronger, an air dielectric breakdown occurs, and thus the Paschen discharge takes place. As a result, negative charges are induced on the surface of the transfer drum 11 (namely, the surface of the dielectric layer 27 in contact with the transfer material P), and positive charges are induced on the inner side of the transfer material P (namely, the surface in contact with the dielectric layer 27).

Furthermore, after the discharge, electric charges are injected into the nip between the semiconductive belt 12 and the transfer drum 11, and negative charges are induced on the outer side of the transfer material P (namely, the surface in contact with the semiconductive rollr 12). As mentioned above, the positive charges are induced on the inner side of the transfer material P by the Paschen discharge or the injection of the electric charges due to the Paschen discharge. Then, the transfer material P electrostatically adheres to the transfer drum 11 by means of the attracting force between the electric charges due to the positive voltage applied from the power source section 32 and the negative charges on the outer side of the transfer material P. This adhering force is not dispersed as long as the applied voltage is stable, so the transfer material P adheres to the transfer drum 11 stably. Moreover, the surface of the transfer drum 11 is uniformly charged by rotating the semiconductive belt 62 and the transfer drum 11.

Next, the transferring process of the transfer material P is described. As shown in FIG. 20, toner having negative charges on its surface adheres to the surface of photoreceptor drum 15. Therefore, when the transfer material P whose surface is negatively charged is fed to the transfer point X, the toner on the photoreceptor drum 15 moves to the transfer material P by means of the attracting force due to the plus voltage applied from the power source section 32 to the conductive layer 26. Namely, when the transfer material P whose surface is negative charged is fed to the transfer point X, it seems that a repulsive force is produced between the transfer material P and toner on the photoreceptor drum 15, but the attracting force, which cancels the repulsive force generated between the transfer material P and the toner on the photoreceptor drum 15, is produced by the power source section 32. As a result, a toner image is transferred onto the transfer material P.

Figure 22:
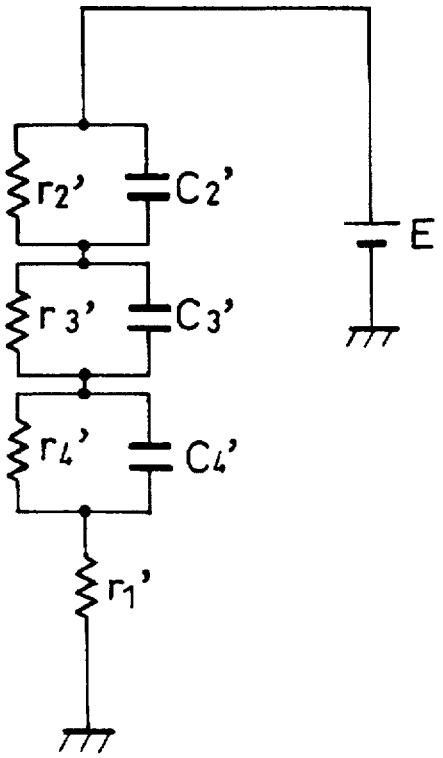
FIG. 22 is an equivalent circuit diagram which shows an electric charge injecting mechanism between the transfer drum and the semiconductor belt shown in FIG. 16.

The equivalent circuit for the injection of electric charges is shown in FIG. 22. The injection of electric charges corresponds to that the electric charges are stored in a capacitor by an electric current flowing the circuit. Namely, E in FIG. 22 represents the applied voltage to be applied from the power source section 32 to the conductive layer 26, r1' represents resistance of the semiconductive belt 62, r2' represents resistance of the dielectric layer 27, r3' represents resistance of the transfer material P, and r4' represents contact resistance between the semiconductive belt 62 and the transfer material P. Moreover, C2' represents an electrostatic capacity of the dielectric layer 27, C3' represents an electrostatic capacity of the transfer material P, and C4' represents an electrostatic capacity of the nip between the semiconductive belt 62 and the transfer material P.

In order to obtain an amount of electric charges (potential) stored in C3', an amount of electric charges (potential) given by the Paschen discharge is set for an initial potential, and the equivalent circuit is solved for a potential difference in C3' so that the charging potential is found by taking the Paschen discharge and charge injection into account. The analytic equation of a final electric potential V3' of the transfer material P thus found is as follows:

$$V3'=\alpha'\times(\beta'\times e^{B'}-\gamma'\times e^{C'}) \quad (2)$$

In the equation (2), α', β', γ', B' and C' represent constants depending on the circuit.

The electric charges (potential), which are stored on the transfer material P in such a manner, has opposite polarity as the voltage applied to the conductive layer 26. For this reason, the attracting force is experience by the transfer material P and the conductive layer 26, and thus the transfer material P electrostaticlly adheres to the transfer drum 11. Namely, it is considered that the higher the charging potential on the transfer material P is, the larger the electrostatic adhering force (F) that makes the transfer material adhere to the transfer drum 11 becomes.

F can be generally represented by the following equation (3):

$$F=q\times E=q\times V/d \quad (3)$$

For this reason, F is proportional to charged electric charges q or charging potential V, and as the value q or V becomes larger, stronger the electrostatic adhering force can be obtained.

FIGS. 23 through 26 are explained. FIGS. 23 through 26 are characteristic drawings which show an amount of injected charges between the semiconductive belt 62 and the transfer drum 11 during the nip time is logically calculated according to the above equation (2). In the drawings, the horizontal axis shows the nip time, the vertical axis shows the charging potential of the transfer material P, and intercepts on the vertical axis show the initial charging potential.

Conditions of the logical calculation in each drawing are shown in Table 5.

TABLE 5

Figure 23:
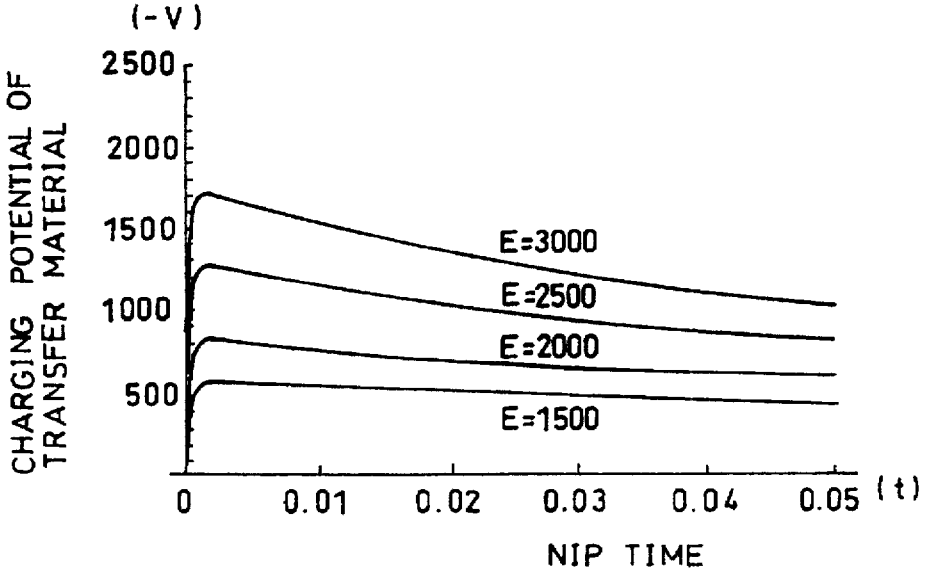
FIG. 23 is a graph which shows a relationship between a charging potential and nip time of the transfer material transported between the transfer drum and the semiconductor belt shown in FIG. 16.
Figure 24:
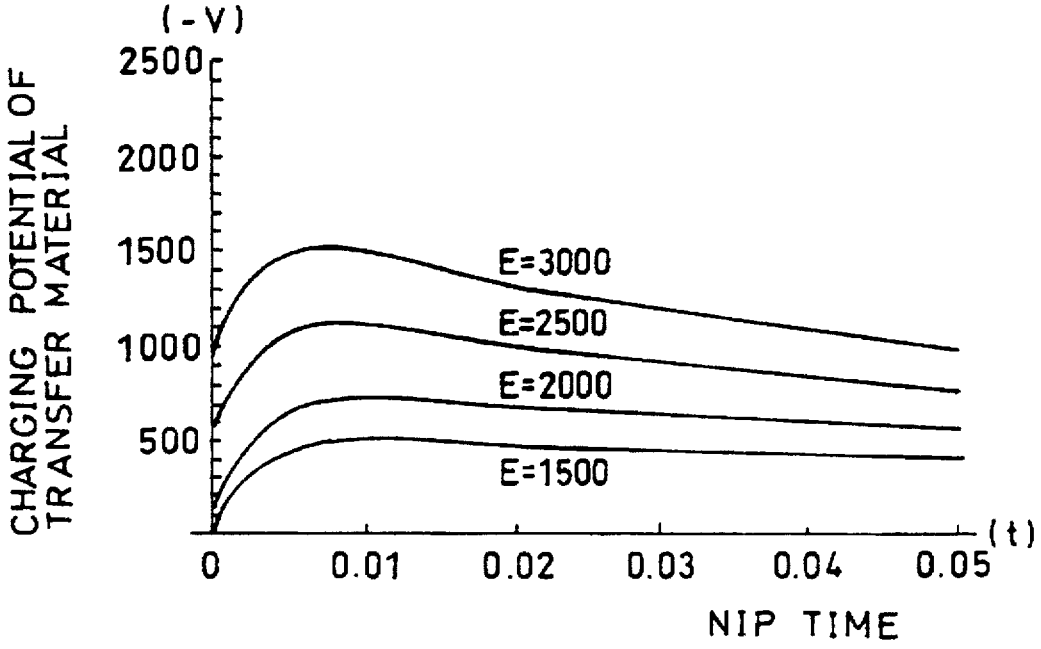
FIG. 24 is a graph which shows a relationship between the charging potential and the nip time of the transfer material in a different condition from FIG. 23.
Figure 25:
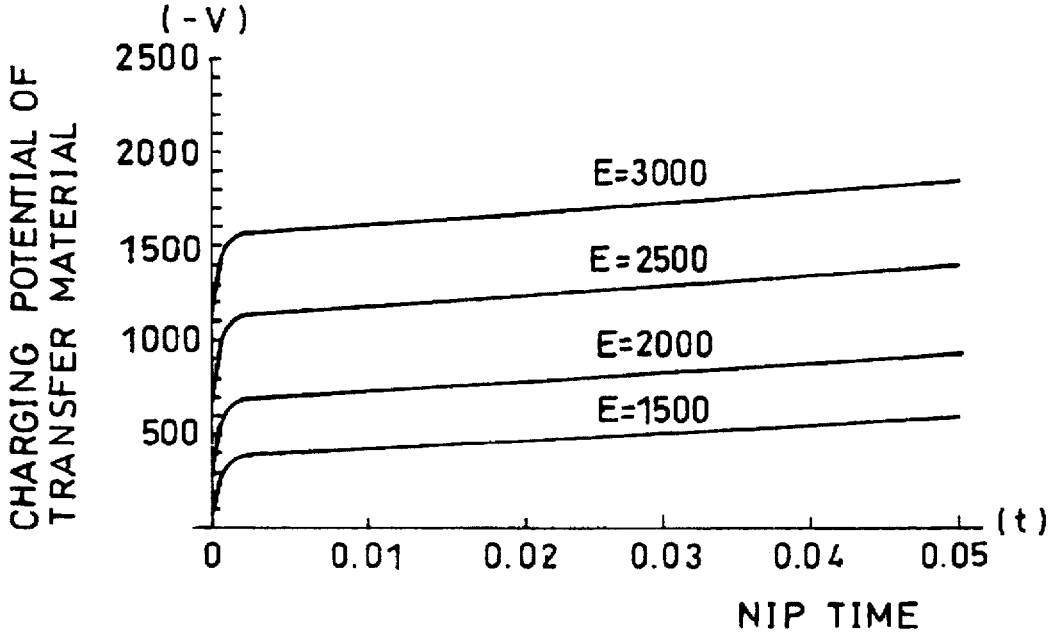
FIG. 25 is a graph which shows a relationship between the charging potential and the nip time of the transfer material in a different condition from FIG. 23 and 24.
Figure 26:
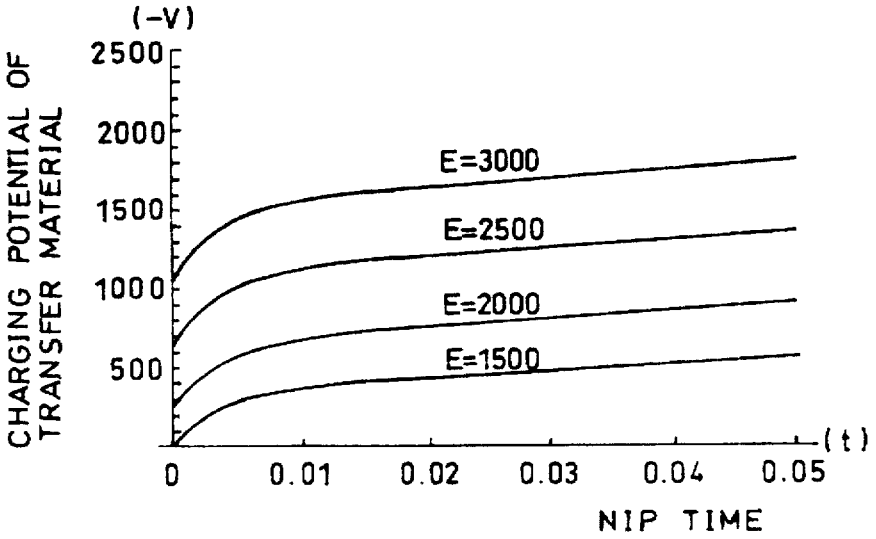
FIG. 26 is a graph which shows a relationship between the charging potential and the nip time of the transfer material in a different condition from FIGS. 23 through 25.

| | Volume resistivity of semiconductive belt 62 (Ωcm) | Volume resistivity of dielectric layer 27 (Ωcm) | Applied voltage (kV) | Type of transfer material P |
|---|---|---|---|---|
| FIG. 23 | $10^8$ | $10^{12}$ | 1.5 | Paper |
| FIG. 24 | $10^9$ | $10^{12}$ | 1.5 | Paper |
| FIG. 25 | $10^8$ | $10^{12}$ | 1.5 | OHP |
| FIG. 26 | $10^9$ | $10^{12}$ | 1.5 | OHP |

In Table 5, OHP means an OHP synthetic resin sheet.

According to FIGS. 23 and 24, it is found that when the transfer material P is paper, the charging potential tends to have a maximal value at a certain nip time, and thereafter the charging potential tends to decrease. It is also found that a time required for approaching the maximal value becomes shorter as the volume resistivity of the semiconductive belt 62 is lower.

Namely, when the transfer material P is paper, when the nip time is set so as to be in the proximity of the maximal value in the characteristic drawings of the charging potential obtained by the logical calculation, the charging potential has the maximum value. Therefore, it is considered that the stable electrostatic adhering force (F) to the transfer drum 11 can be obtained. Or, if the nip time in the proximity of the maximal value is not a practical time (too short), it is considered that the nip time should be made enough long for necessity and as short as possible.

In addition, according to FIGS. 25 and 26, it is found that when the transfer material P is the OHP synthetic resin sheet, the charging potential tends to increase over the nip time. Namely, it is considered that when the nip time is set enough longer for the charging potential, which is required for the stable electrostatic adhesion of the OHP synthetic resin sheet to the transfer drum 11, can be obtained, higher charging potential can be obtained.

As mentioned above, the tendency to obtaining the charging potential is different with a type of the transfer material P. For this reason, it is necessary to adjust the nip time according to the type of the transfer material P so that charging potential for the stable electrostatic adhesion to the transfer drum 11 is obtained.

Figure 27:
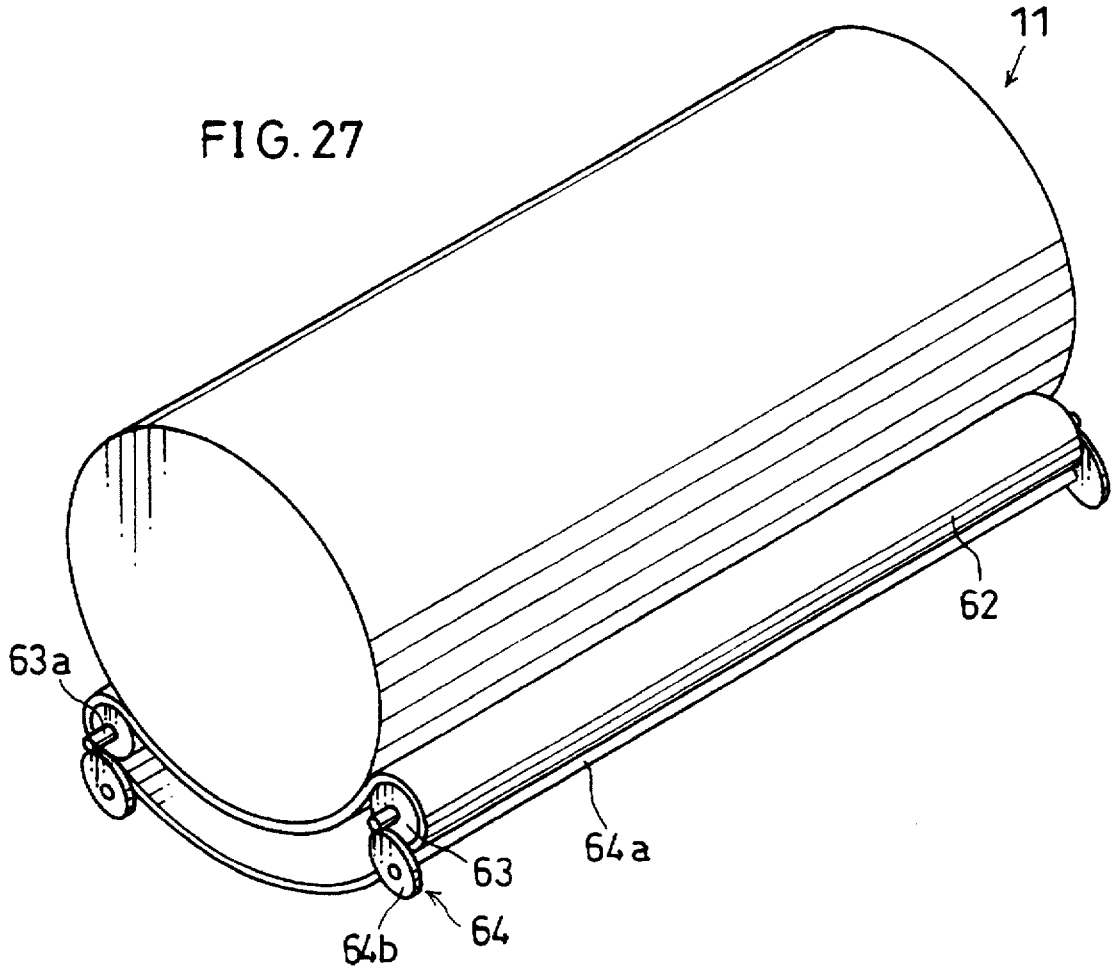
FIG. 27 is an explanatory drawing which shows an arrangement for changing contact pressure between the transfer drum and the semiconductor belt shown in FIG. 16.
Figure 28:
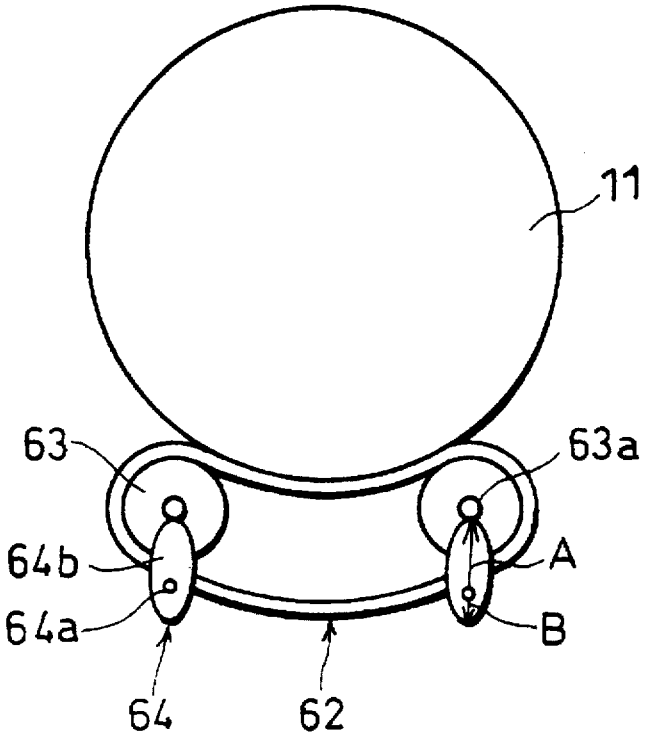
FIG. 28 is an explanatory drawing which shows a condition where a nip width between the transfer drum and the semiconductor belt shown in FIG. 16 is adjusted so as to be maximum (longest nip time).
Figure 29:
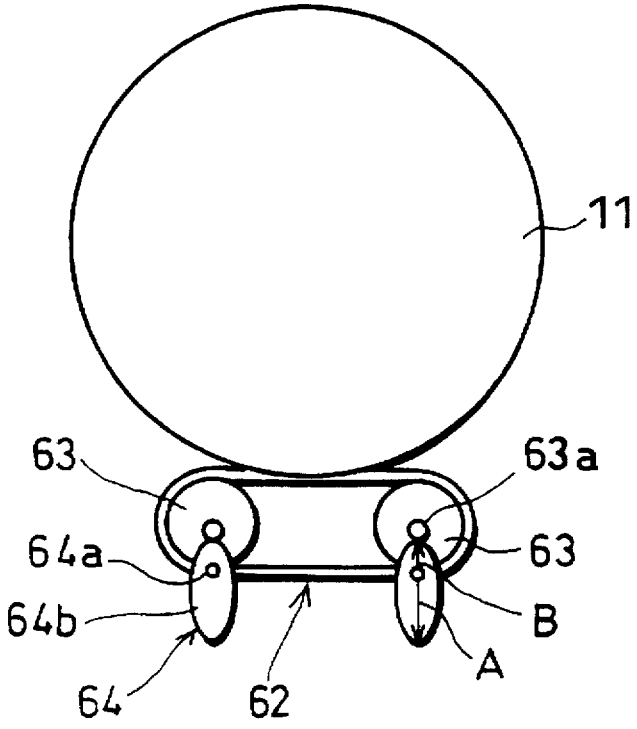
FIG. 29 is an explanatory drawing which shows a condition where the nip width between the transfer drum and the semiconductor belt shown in FIG. 16 is adjusted so as to be minimum (shortest nip time).

In order to adjust the charging potential so that it is suitable to a type of paper as the transfer material P, for example, a transfer material detecting sensor 33 shown in FIG. 16 and an eccentric cam 64 shown in FIGS. 27 through 29 may be used. In this case, first, the type of the transfer material (paper or OHP synthetic resin sheet) is detected by measuring transmittance of the transfer material P to be fed or the type of transfer material (thick paper or thin paper) is detected by measuring a thickness of the transfer material using transfer material detecting sensor 33. Then, the contact width between the semiconductive belt 62 and the transfer drum 11 is adjusted by the eccentric cams 64 according to the result detected by the transfer material detecting sensor 33, and the width of the feeding direction of the transfer material P at the nip between the semiconductive belt 62 and the transfer drum 11 is adjusted so that the nip time is changed. As a result, the charging potential can be adjusted so as to be suitable to the type of the transfer material P.

In other words, in order to adjust the charging potential so that it is suitable to the type of the transfer material P, as shown in FIGS. 27 through 29, contact pressure changing means (nip width adjusting means), which includes the eccentric cams 64 for pressing the semiconductive belt 62 against the transfer drum 11 is provided below the semiconductive belt 62 so that the eccentric cams 64 adjust the pressing force. As a result, the contact width between the semiconductive belt 62 and the transfer drum 11 is adjusted so that the nip time can be changed.

As shown in FIG. 27, the eccentric cam 64 is composed of a rotating shaft **64*a* and pressing members 64*b*. The pressing member 64*b* is made of an elliptic board and is provide on both the ends of the rotating shaft 64*a*. The eccentric cam 64 is located so that the pressing members 64*b* are in contact with a shaft 63*a* of the supporting roller 63 for supporting the semiconductive belt 62. The rotating shaft 64*a* supports the pressing members 64*b* in a position which is off-centered from the pressing member 64*b*, and is located in parallel with the shaft 63*a* of the supporting roller 63 which supports the semiconductive belt 62**.

As shown in FIG. 28 which shows the transfer drum 11, the semiconductive belt 62 and the eccentric cam 64 viewed from the side face, the nip time between the transfer drum 11 and the semiconductive belt 62 is adjusted so as to be longest (nip width becomes longest) when the rotating shaft **64*a* is the farthest from the shaft 63*a* (in the drawing, the distance between the rotating shaft 64*a* and the shaft 63*a* becomes A), and as shown in FIG. 29, the nip time becomes shortest (nip width is shortest) when the rotating shaft 64*a* is the closest to the shaft 63*a* (in the drawing the distance between the rotating shaft 64*a* and the shaft 63*a* becomes B). As a result, the force of the eccentric cam 64 for pressing the semiconductive belt 62 is adjusted by rotating the eccentric cam 64, thereby adjusting the nip width between the transfer drum 11 and the semiconductive belt 62. The pressing member 64b is not limited as long as its contact portion with the shaft 63a**, i.e. a circumferential edge has a curved shape, so a circular board or a globe may be used.

As mentioned above, since the semiconductive belt 62 of the present embodiment is made of a semiconductor having elasticity, the contact width between the semiconductive belt 62 and the transfer drum 11 can be easily changed by the eccentric cam 64 or the like. Therefore, in accordance with the above arrangement, the nip time can be easily adjusted.

Here, A relationship between a thickness of the semiconductive belt 62 and durability of the semiconductive belt 62, and a relationship between the thickness of the semiconductive belt 62 and conformability of the semiconductive belt 62 with the transfer drum 11 or the transfer material P are shown in Table 6.

TABLE 6

| Thickness of semiconductive belt (mm) | less than 1 | 1 | 2 | 3 | 4 | 5 | 6 |
|---|---|---|---|---|---|---|---|
| Durability/ Contact | x | Δ | ○ | ○ | ○ | Δ | x |

x: unsatisfactory,
Δ: satisfactory,
○: excellent

According to Table 6, it is preferable that the thickness of the semiconductive belt 62 is 1 mm–5 mm. Moreover, the semiconductive belt 62 having thickness of less than 1 mm is unsatisfactory in durability, and thus it cannot be used for a long time. Therefore, it is not suitable. Meanwhile, since the semiconductive belt 62 having thickness of not less than 6 mm is too thick, the contact between the semiconductive belt 62 and the transfer drum 11 or the transfer material P is not satisfactory. Therefore, it is impossible to supply the electric charges stably. This tendency is applicably widely as long as it is made of a semiconductive material having elasticity.

In addition, the relationship between the volume resistivity of the semiconductive belt 62 and the adhesion characteristic of the transfer material P is shown in Table 7.

TABLE 7

| Volume resistivity | $\leqq 10^5$ | $10^6$ | $10^7$ | $10^8$ | $10^9$ | $10^{10}$ | $10^{11}$ | $10^{12} \leqq$ |
|---|---|---|---|---|---|---|---|---|
| Adhesion characteristic of transfer material | x | Δ | ○ | ○ | ○ | Δ | Δ | x |

unit: Ω · cm x: unsatisfactory
Δ: satisfactory,
○: excellent

According to Table 7, it is considered that the suitable volume resistivity of the semiconductive belt 62 is between $10^6$ Ω·cm and $10^{11}$ Ω·cm. In the volume resistivity of not more than $10^5$ Ω·cm, the material of the semiconductive belt 62 becomes too soft, and thus the durability is deteriorated. Meanwhile, since the volume resistivity of not less than $10^{12}$ Ω·cm is too high, an amount of electric charges to be supplied to the transfer material P becomes small, and thus a high charging potential cannot be obtained. As a result, the transfer material P cannot electrostatically adhere to the transfer drum 11 stably.

Table 7 shows the experiment results obtained as to all the materials which can be considered as the transfer material P, and needless to say, the adhesion characteristic of paper or OHP synthetic resin sheet, etc. falls within the range of Table 7. Moreover, the stable electrostatic adhesion means that the transfer material P adheres to the transfer drum 11 with the forward end or the backward end of the transfer material P not being separated from the transfer drum 11 during the toner transfer. Namely, while the transfer drum 11 rotates at most four times, the transfer material P adheres to the transfer drum 11 without separating therefrom.

Like the present embodiment, when the semiconductive belt 62 having elasticity is used as the grounded electrode member (potential difference generating means), the nip time can be adjusted more easily than the case where the semiconductive roller 12 having elasticity is used in embodiment 1, and a contact width between the electrode member and the transfer drum 11 in the feeding direction of the transfer material P is made longer. Therefore, when the OHP synthetic resin sheet, for example, is used as the transfer material P, the nip time made longer. As a result, the charging potential of the transfer material P is increased, and the transfer material P electrostatically adheres to the transfer drum 11 more stably. Moreover, when the contact width between the electrode member and the transfer drum 11 in the feeding direction of the transfer material P is made long in such a manner, the transfer material P can be brought into contact with the transfer drum 11 by pressure for a longer time, thereby curling the transfer drum P along the transfer drum 11. As a result, the transfer material P can adhered and be retained more stably.

[EMBODIMENT 5]

Figure 30:
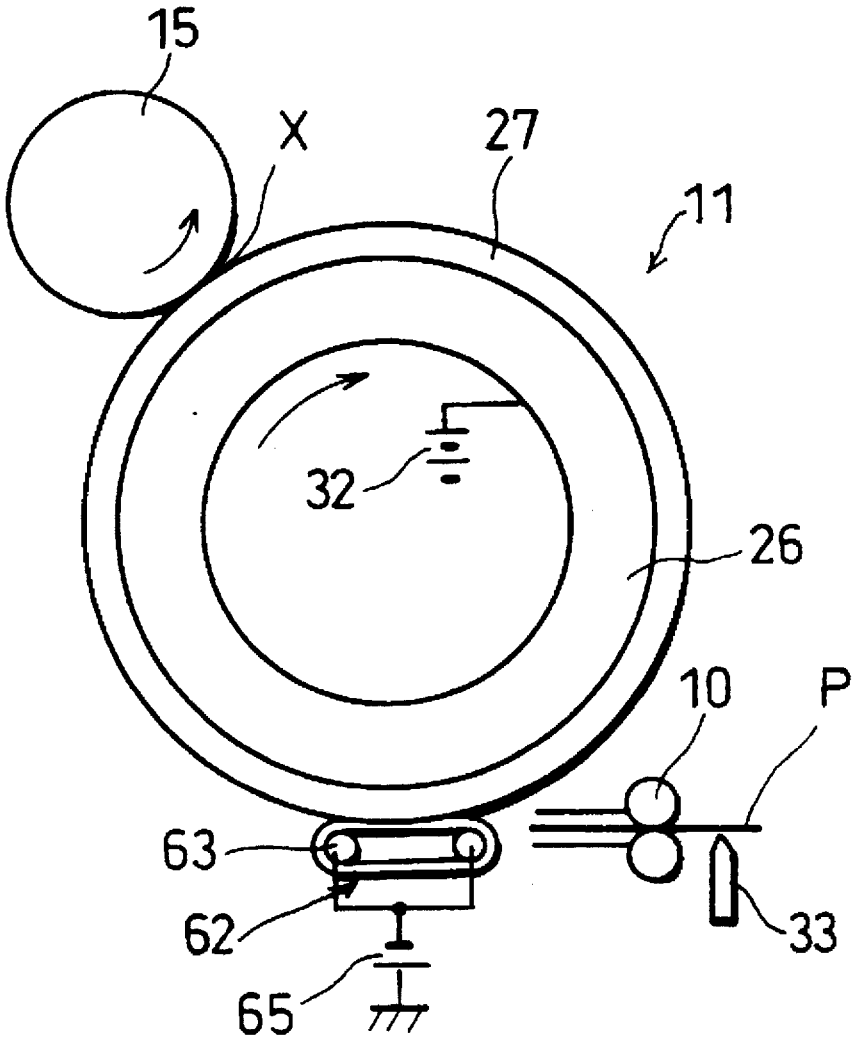
FIG. 30 is a schematic constitutional drawing which shows the proximity of the transfer drum in the image forming apparatus of embodiment 5.
Figure 31:
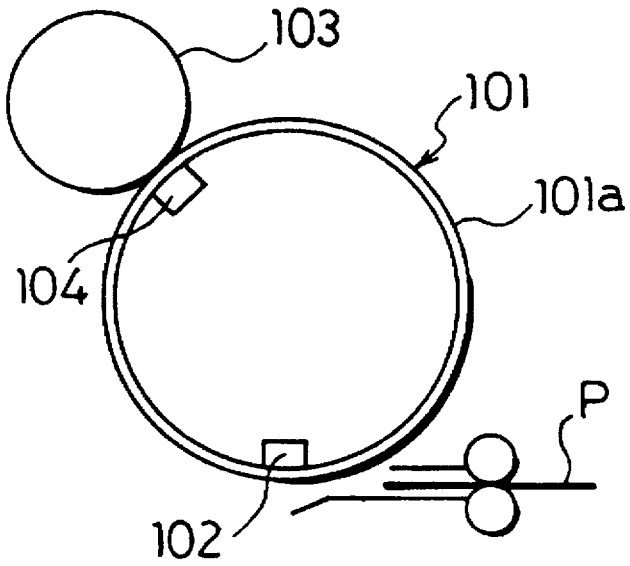
FIG. 31 PRIOR ART
FIG. 31 is a schematic constitutional drawing which shows a conventional image forming apparatus.
Figure 32:
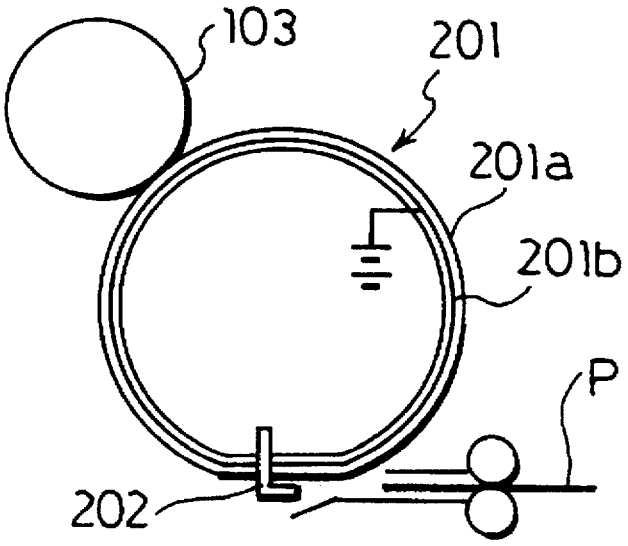
FIG. 32 PRIOR ART
FIG. 32 is a schematic constitutional drawing which shows another conventional image forming apparatus.

The following describes still another embodiment of the present invention on reference to FIG. 30.

The image forming apparatus of the present embodiment is arranged so as to further include a power source section 65 for applying a voltage to the semiconductive belt 62 shown in FIG. 16 in the embodiment 4. Since the image forming apparatus of the present embodiment is provided with the power source section 65, the electrostatic adhesion can be improved by heightening the charging potential of the transfer material P. Furthermore, since two power source resources (power source section 32 and power source section 65) exist, the voltage to be applied to the conductive layer 26 may be set so as to have a suitable value for the toner transfer by the power source section 32, and the voltage required for the adhesion may be adjusted by the power source section 65.

In addition, since the two voltage supply sources exists and thus the voltages can be adjusted respectively, the voltage required for the toner transfer and the voltage required for the electrostatic adhesion can be independently controlled according to environment and a type of the transfer material P. Therefore, in accordance with the above arrangement, the more satisfactory effects can be obtained compared with the case without the power source section 65.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

an image carrier on which a toner image is formed;

transfer means for transferring the toner image formed on said image carrier onto a transfer material by bringing the transfer material into contact with said image carrier, said transfer means having a dielectric layer and a first conductive layer laminated in this order from a contact surface side of the transfer material;

voltage applying means, connected to the conductive layer, for applying a predetermined voltage to the conductive layer; and potential difference generating means, which is brought into contact with the surface of the dielectric layer through the transfer material and is made of at least a semiconductive body having elasticity, for generating a potential difference between the conductive layer to which the voltage is applied and the transfer material, said potential difference generating means being provided on an upper stream side of a feeding direction of the transfer material from a transfer position on the surface of the dielectric layer wherein said potential difference generating means is a grounded semiconductive belt at least including a semiconductive layer made of the semiconductive body having elasticity.

2. The image forming apparatus according to claim 1 wherein said potential difference generating means is a grounded electrode member.

3. The image forming apparatus according to claim 1, wherein said potential difference generating means includes a second conductive layer laminated adjacent to a semiconductive layer made of the semiconductive body having elasticity.

4. The image forming apparatus according to claim 1, wherein said semiconductive belt has a volume resistivity set within a range between $10^6$ Ω·cm and $10^{11}$ Ω·cm.

5. The image forming apparatus according to claim 1, wherein a thickness of the semiconductive belt is set within a range between 1 mm and 5 mm.

6. The image forming apparatus according to claim 1, wherein said potential difference generating means includes a semiconductive layer made of urethane foam or silicon.

7. The image forming apparatus according to claim 1, wherein dielectric layer is made of polyvinylidene fluoride or polyethylene terephthalate.

8. The image forming apparatus according to claim 1, wherein volume resistivity of the dielectric layer is set within a range between $10^9$ Ω·cm and $10^{15}$ Ω·cm.

9. The image forming apparatus according to claim 1, wherein the dielectric layer and the first conductive layer are brought into contact with and are fixed to each other so that a void is not produced.

10. The image forming apparatus according to claim 1, wherein said dielectric layer is a cylindrical seamless thin film sheet made of polyvinylidene fluoride which is brought into contact with and fixed to the first conductive layer due to thermal shrinkage.

11. The image forming apparatus according to claim 1, wherein the dielectric layer and the first conductive layer are brought into contact with and are fixed to each other by a conductive adhesive.

12. The image forming apparatus according to claim 1, wherein:

said transfer means is formed in cylindrical shape as a transfer drum, said potential difference generating means is driven by rotation of the transfer drum so as to be rotated.

13. The image forming apparatus according to claim 1, further comprising pre-curling means for giving curvature along said transfer means to the transfer material to be fed between said transfer means and said potential difference generating means.

14. The image forming apparatus according to claim 1, further comprising cleaning means for removing residual toner on the surface of said transfer means.

15. The image forming apparatus according to claim 1 further comprising charge eliminating means for removing residual electric charges adhering to the surface of said transfer means.

16. The image forming apparatus according to claim 1, further comprising a corona charging means provided downstream of said potential difference generating means in the feeding direction of the transfer material, for applying a constant potential to the transfer material.

17. The image forming apparatus according to claim 1, further comprising a voltage supplying source for applying a voltage, which has opposite polarity to said voltage applying means, to said potential difference generating means.

18. An image forming apparatus comprising:

an image carrier on which a toner image is formed;

transfer means for transferring the toner image formed on said image carrier onto a transfer material by bringing the transfer material into contact with said image carrier, said transfer means having a dielectric layer and a first conductive layer laminated in this order from a contact surface side of the transfer material;

voltage applying means, connected to the conductive layer, for applying a predetermined voltage to the conductive layer;

potential difference generating means, which is brought into contact with the surface of the dielectric layer through the transfer material and is made of at least a semiconductive body having elasticity, for generating a potential difference between the conductive layer to which the voltage is applied and the transfer material, said potential difference generating means being provided on an upper stream side of a feeding direction of the transfer material from a transfer position on the surface of the dielectric layer; and nip time changing means for changing nip time for a predetermined position of the transfer material to pass through the contact portion between said transfer means and said potential difference generating means according to a type of the transfer material.

19. The image forming apparatus according to claim 18, wherein said nip time changing means includes nip width adjusting means for adjusting a nip width which is a width in a moving direction of the transfer material at the contact portion between said transfer means and said potential difference generating means.

20. The image forming apparatus according to claim 19, wherein said nip width adjusting means includes contact pressure changing means for changing contact pressure between said transfer means and said potential difference generating means.

21. The image forming apparatus according to claim 20, wherein said contact pressure changing means includes an eccentric cam for displacing a relative position of said potential difference generating means with respect to said transfer means.

22. The image forming apparatus according to claim 18, further comprising:

detecting means for detecting a type of the transfer material; and storage means for storing information showing a relationship between the nip time and an amount of electric charges of the transfer material according to the type of the transfer material, wherein said nip time changing means changes the nip time by obtaining nip time according to the type of transfer material detected by said detecting means from the information in said storage means.

23. The image forming apparatus according to claim 22, wherein when judging that the relationship between the nip time and an amount of electric charges of the transfer material is satisfied so that the amount of electric charges of the transfer material has a maximal value with respect to a certain nip time from the information detected by said detecting means, said nip time changing means adjusts the nip time so that an amount of electric charges of the transfer material does not become smaller than an initial amount of electric charges based upon the information in said storage means.

24. The image forming apparatus according to claim 22, wherein when judging that the relationship between the nip time and an amount of electric charges of the transfer material is satisfied so that the amount of electric charges of the transfer material has a maximal value with respect to a certain nip time from the information detected by said detecting means, said nip time changing means adjusts the nip time so as to corresponds to the maximal value of the amount of electric charges based upon the information in said storage means.

25. The image forming apparatus according to claim 22, wherein when judging that the relationship between the nip time and an amount of electric charges of the transfer material is satisfied so that as the nip time becomes longer, an amount of electric charges of the transfer material is decreased smaller than an initial amount of electric charges from the information detected by said detecting means, said nip time changing means adjusts the nip time so that an amount of electric charges of the transfer material becomes not less than 50% of the initial amount of electric charges based upon the information in said storage means.

26. The image forming apparatus according to claim 18, wherein said potential difference generating means is formed at least by using the semiconductive body having elasticity, and is a grounded semiconductive roller.

27. The image forming apparatus according to claim 18, wherein said potential difference generating means is a grounded semiconductive roller which has a volume resistivity set within a range between $10^6$ Ω·cm and $10^{11}$ Ω·cm.

28. The image forming apparatus according to claim 18, wherein said potential difference generating means is a grounded semiconductive belt at least including a semiconductive layer made of the semiconductive body having elasticity.

29. The image forming apparatus according to claim 18, wherein said potential difference generating means is a semiconductive belt which has a volume resistivity set within a range between $10^6$ Ω·cm and $10^{11}$ Ω·cm.

30. An image forming apparatus, comprising:

an image carrier on which a toner image is formed;

transfer means for transferring the toner image formed on said image carrier onto a transfer material by bringing the transfer material into contact with said image carrier, said transfer means having a dielectric layer and a conductive layer laminated in this order from a contact surface side of the transfer material;

voltage applying means, connected to said conductive layer, for applying a predetermined voltage to said conductive layer; and potential difference generating means, which is brought into contact with the surface of the dielectric layer through the transfer material, for generating a potential difference between the conductive layer to which the voltage is applied and the transfer material, said potential difference generating means being provided on an upper stream side of a feeding direction of the transfer material from a transfer position on the surface of the dielectric layer, wherein said image carrier and said potential difference generating means are located in a position where a forward end of the transfer material in the feeding direction is in contact with said image carrier after a backward end of the transfer material in the feeding direction passes through said potential difference generating means.

31. The image forming apparatus according to claim 30, wherein said potential difference generating means is made of at least a semiconductive body having elasticity.

32. The image forming apparatus according to claim 30, wherein said potential difference generating means is a grounded electrode member.

33. The image forming apparatus according to claim 30, wherein said potential difference generating means is made of at least a semiconductive body having elasticity, and is a grounded semiconductive roller.

34. The image forming apparatus according to claim 33, wherein said semiconductive roller has a volume resistivity set within a range between $10^6$ Ω·cm and $10^{11}$ Ω·cm.

35. The image forming apparatus according to claim 30, wherein said potential difference generating means is a grounded semiconductive belt including at least a semiconductive layer made of a semiconductive body having elasticity.

36. The image forming apparatus according to claim 35, wherein said semiconductive belt has a volume resistivity set within a range between $10^6$ Ω·cm and $10^{11}$ Ω·cm.

37. The image forming apparatus according to claim 30, wherein a distance from said potential difference generating means to said image carrier towards the feeding direction of the transfer material has a longer length than a length of the transfer material in the feeding direction.

38. The image forming apparatus according to claim 30, wherein a distance from said potential difference generating means to said image carrier towards the feeding direction of the transfer material has a longer length than a maximum longitudinal feeding size of the transfer material.

39. The image forming apparatus according to claim 30, further comprising voltage switching means for switching the voltage of said voltage applying means before the forward end of the transfer material in the feeding direction is brought into contact with said image carrier after a backward end of the transfer material in the feeding direction passes through said potential difference generating means.

40. The image forming apparatus according to claim 39, wherein said voltage switching means switches the voltage of said voltage applying means so that a transfer voltage which is lower than an adhesion voltage is applied to said conductive layer when the transfer is executed.

* * * * *